US007204100B2

(12) United States Patent
Wilkinson et al.

(10) Patent No.: US 7,204,100 B2
(45) Date of Patent: Apr. 17, 2007

(54) NATURAL GAS LIQUEFACTION

(75) Inventors: John D. Wilkinson, Midland, TX (US); Joe T. Lynch, Midland, TX (US); Hank M. Hudson, Midland, TX (US); Kyle T. Cuellar, Katy, TX (US)

(73) Assignee: Ortloff Engineers, Ltd., Midland, TX (US)

( * ) Notice: Subject to any disclaimer, the term of this patent is extended or adjusted under 35 U.S.C. 154(b) by 399 days.

(21) Appl. No.: 10/840,072

(22) Filed: May 4, 2004

(65) Prior Publication Data

US 2005/0247078 A1 Nov. 10, 2005

(51) Int. Cl.
*F25J 1/00* (2006.01)
*F25J 3/00* (2006.01)

(52) U.S. Cl. ..... 62/612; 62/620; 62/613

(58) Field of Classification Search ..... 62/612, 62/613, 620

See application file for complete search history.

(56) References Cited

U.S. PATENT DOCUMENTS

| | | | | |
|---|---|---|---|---|
| 2,952,984 | A | 9/1960 | Marshall | 62/622 |
| 3,292,380 | A | 12/1966 | Bucklin | 62/20 |
| 3,837,172 | A | 9/1974 | Markbreiter et al. | 62/621 |
| 4,140,504 | A | 2/1979 | Campbell et al. | 62/621 |
| 4,157,904 | A | 6/1979 | Campbell et al. | 62/623 |
| 4,171,964 | A | 10/1979 | Campbell et al. | 62/621 |

(Continued)

FOREIGN PATENT DOCUMENTS

FR 1535846 A 8/1968

WO 01/88447 A1 11/2001

(Continued)

OTHER PUBLICATIONS

Huang et al., "Select the Optimum Extraction Method for LNG Regasification; Varying Energy Compositions of LNG Imports may Require Terminal Operators to Remove $C_2$+ Compounds before Injecting Regasified LNG into Pipelines", *Hydrocarbon Processing*, 83, 57-62, Jul. 2004.

(Continued)

*Primary Examiner*—William C. Doerrler
(74) *Attorney, Agent, or Firm*—Fitzpatrick, Cella, Harper & Scinto

(57) ABSTRACT

A process for liquefying natural gas in conjunction with producing a liquid stream containing predominantly hydrocarbons heavier than methane is disclosed. In the process, the natural gas stream to be liquefied is partially cooled and divided into first and second streams. The first stream is further cooled to condense substantially all of it, expanded to an intermediate pressure, and then supplied to a distillation column at a first mid-column feed position. The second stream is also expanded to intermediate pressure and is then supplied to the column at a second lower mid-column feed position. A distillation stream is withdrawn from the column below the feed point of the second stream and is cooled to condense at least a part of it, forming a reflux stream. At least a portion of the reflux stream is directed to the distillation column as its top feed. The bottom product from this distillation column preferentially contains the majority of any hydrocarbons heavier than methane that would otherwise reduce the purity of the liquefied natural gas. The residual gas stream from the distillation column is compressed to a higher intermediate pressure, cooled under pressure to condense it, and then expanded to low pressure to form the liquefied natural gas stream.

65 Claims, 8 Drawing Sheets

U.S. PATENT DOCUMENTS

| | | | | |
|---|---|---|---|---|
| 4,185,978 | A | 1/1980 | McGalliard et al. | 62/634 |
| 4,251,249 | A | 2/1981 | Gulsby | 62/621 |
| 4,278,457 | A | 7/1981 | Campbell et al. | 62/621 |
| 4,445,917 | A | 5/1984 | Chiu | 62/625 |
| 4,519,824 | A | 5/1985 | Huebel | 62/621 |
| 4,525,185 | A | 6/1985 | Newton | 62/612 |
| 4,545,795 | A | 10/1985 | Liu et al. | 62/613 |
| 4,600,421 | A | 7/1986 | Kummann | 62/621 |
| 4,617,039 | A | 10/1986 | Buck | 62/621 |
| 4,687,499 | A | 8/1987 | Aghili | 62/621 |
| 4,689,063 | A | 8/1987 | Paradowski et al. | 62/627 |
| 4,690,702 | A | 9/1987 | Paradowski et al. | 62/621 |
| 4,707,170 | A | 11/1987 | Ayres et al. | 62/627 |
| 4,710,214 | A | 12/1987 | Sharma et al. | 62/621 |
| 4,755,200 | A | 7/1988 | Liu et al. | 62/612 |
| 4,851,020 | A | 7/1989 | Montgomery, IV | 62/621 |
| 4,854,955 | A | 8/1989 | Campbell et al. | 62/621 |
| 4,869,740 | A | 9/1989 | Campbell et al. | 62/621 |
| 4,889,545 | A | 12/1989 | Campbell et al. | 62/621 |
| 4,895,584 | A | 1/1990 | Buck et al. | 62/621 |
| RE33,408 | E | 10/1990 | Khan | 62/29 |
| 5,114,451 | A | 5/1992 | Rambo et al. | 62/623 |
| 5,275,005 | A | 1/1994 | Campbell et al. | 62/621 |
| 5,291,736 | A | 3/1994 | Paradowski | 62/613 |
| 5,363,655 | A | 11/1994 | Kikkawa et al. | 62/613 |
| 5,365,740 | A | 11/1994 | Kikkawa et al. | 62/613 |
| 5,555,748 | A | 9/1996 | Campbell et al. | 62/621 |
| 5,566,554 | A | 10/1996 | Vijayaraghavan et al. | 62/621 |
| 5,568,737 | A | 10/1996 | Campbell et al. | 62/621 |
| 5,600,969 | A | 2/1997 | Low | 62/622 |
| 5,615,561 | A | 4/1997 | Houshmand et al. | 62/611 |
| 5,651,269 | A | 7/1997 | Prevost et al. | 62/613 |
| 5,755,114 | A | 5/1998 | Foglietta | 62/618 |
| 5,755,115 | A | 5/1998 | Manley | 62/620 |
| 5,771,712 | A | 6/1998 | Campbell et al. | 62/621 |
| 5,799,507 | A | 9/1998 | Wilkinson et al. | 62/621 |
| 5,881,569 | A | 3/1999 | Campbell et al. | 62/621 |
| 5,890,378 | A | 4/1999 | Rambo et al. | 62/621 |
| 5,893,274 | A | 4/1999 | Nagelvoort et al. | 62/613 |
| 5,983,664 | A | 11/1999 | Campbell et al. | 62/621 |
| 6,014,869 | A | 1/2000 | Elion et al. | 62/621 |
| 6,023,942 | A | 2/2000 | Thomas et al. | 62/613 |
| 6,053,007 | A | 4/2000 | Victory et al. | 62/619 |
| 6,062,041 | A | 5/2000 | Kikkawa et al. | 62/613 |
| 6,116,050 | A | 9/2000 | Yao et al. | 62/630 |
| 6,119,479 | A | 9/2000 | Roberts et al. | 62/612 |
| 6,125,653 | A | 10/2000 | Shu et al. | 62/622 |
| 6,182,469 | B1 * | 2/2001 | Campbell et al. | 62/621 |
| 6,250,105 | B1 | 6/2001 | Kimble | 62/613 |
| 6,269,655 | B1 | 8/2001 | Roberts et al. | 62/612 |
| 6,272,882 | B1 | 8/2001 | Hodges et al. | 62/613 |
| 6,308,531 | B1 | 10/2001 | Roberts et al. | 62/611 |
| 6,324,867 | B1 | 12/2001 | Fanning et al. | 62/613 |
| 6,336,344 | B1 | 1/2002 | O'Brien | 62/627 |
| 6,347,532 | B1 | 2/2002 | Agrawal et al. | 62/612 |
| 6,363,744 | B2 | 4/2002 | Finn et al. | 62/621 |
| 6,367,286 | B1 | 4/2002 | Price | 62/613 |
| 6,526,777 | B1 | 3/2003 | Campbell et al. | 62/621 |
| 6,604,380 | B1 | 8/2003 | Reddick et al. | 62/620 |
| 6,742,358 | B2 | 6/2004 | Wilkinson et al. | 62/613 |
| 6,907,752 | B2 | 6/2005 | Schroeder et al. | 62/620 |
| 6,941,771 | B2 | 9/2005 | Reddick et al. | 62/620 |
| 2003/0005722 | A1 * | 1/2003 | Wilkinson et al. | 62/613 |
| 2003/0158458 | A1 | 8/2003 | Prim | 585/800 |
| 2004/0079107 | A1 | 4/2004 | Wilkinson et al. | 62/611 |
| 2005/0061029 | A1 | 3/2005 | Narinsky | 62/620 |
| 2005/0155381 | A1 | 7/2005 | Yang et al. | 62/620 |

FOREIGN PATENT DOCUMENTS

| | | | |
|---|---|---|---|
| WO | 2004/109180 | A | 12/2004 |
| WO | 2005/015100 | A | 2/2005 |
| WO | 2005/035692 | A | 4/2005 |

OTHER PUBLICATIONS

Yang et al., "Cost-Effective Design Reduces $C_2$ and $C_3$ at LNG Receiving Terminals", *Oil & Gas Journal*, 50-53, May 26, 2003.

U.S. Appl. No. 09/677,220, filed Oct. 2000, Spec. & Figs.

Finn, Adrian J., Grant L. Johnson, and Terry R. Tomilson, "LNG Technology for Offshore and Mid-Scale Plants", Proceedings of the Seventy-Ninth Annual Convention of the Gas Processors Association, pp. 429-450, Atlanta, Georgia, Mar. 13-15, 2000.

Kikkawa, Yoshitsugi, Masaaki Ohishi, and Noriyoshi Nozawa, "Optimize the Power System of Baseload LNG Plant", Proceedings of the Eightieth Annual Convention of the Gas Processors Association, San Antonio, Texas, Mar. 12-14, 2001.

Price, Brian C., "LNG Production for Peak Shaving Operations", Proceedings of the Seventy-Eighth Annual Convention of the Gas Processors Association, pp. 273-280, Nashville, Tennessee, Mar. 1-3, 1999.

* cited by examiner

NATURAL GAS LIQUEFACTION

BACKGROUND OF THE INVENTION

This invention relates to a process for processing natural gas or other methane-rich gas streams to produce a liquefied natural gas (LNG) stream that has a high methane purity and a liquid stream containing predominantly hydrocarbons heavier than methane.

Natural gas is typically recovered from wells drilled into underground reservoirs. It usually has a major proportion of methane, i.e., methane comprises at least 50 mole percent of the gas. Depending on the particular underground reservoir, the natural gas also contains relatively lesser amounts of heavier hydrocarbons such as ethane, propane, butanes, pentanes and the like, as well as water, hydrogen, nitrogen, carbon dioxide, and other gases.

Most natural gas is handled in gaseous form. The most common means for transporting natural gas from the wellhead to gas processing plants and thence to the natural gas consumers is in high pressure gas transmission pipelines. In a number of circumstances, however, it has been found necessary and/or desirable to liquefy the natural gas either for transport or for use. In remote locations, for instance, there is often no pipeline infrastructure that would allow for convenient transportation of the natural gas to market. In such cases, the much lower specific volume of LNG relative to natural gas in the gaseous state can greatly reduce transportation costs by allowing delivery of the LNG using cargo ships and transport trucks.

Another circumstance that favors the liquefaction of natural gas is for its use as a motor vehicle fuel. In large metropolitan areas, there are fleets of buses, taxi cabs, and trucks that could be powered by LNG if there were an economic source of LNG available. Such LNG-fueled vehicles produce considerably less air pollution due to the clean-burning nature of natural gas when compared to similar vehicles powered by gasoline and diesel engines which combust higher molecular weight hydrocarbons. In addition, if the LNG is of high purity (i.e., with a methane purity of 95 mole percent or higher), the amount of carbon dioxide (a "greenhouse gas") produced is considerably less due to the lower carbon:hydrogen ratio for methane compared to all other hydrocarbon fuels.

The present invention is generally concerned with the liquefaction of natural gas while producing as a co-product a liquid stream consisting primarily of hydrocarbons heavier than methane, such as natural gas liquids (NGL) composed of ethane, propane, butanes, and heavier hydrocarbon components, liquefied petroleum gas (LPG) composed of propane, butanes, and heavier hydrocarbon components, or condensate composed of butanes and heavier hydrocarbon components. Producing the co-product liquid stream has two important benefits: the LNG produced has a high methane purity, and the co-product liquid is a valuable product that may be used for many other purposes. A typical analysis of a natural gas stream to be processed in accordance with this invention would be, in approximate mole percent, 84.2% methane, 7.9% ethane and other $C_2$ components, 4.9% propane and other $C_3$ components, 1.0% iso-butane, 1.1% normal butane, 0.8% pentanes plus, with the balance made up of nitrogen and carbon dioxide. Sulfur containing gases are also sometimes present.

There are a number of methods known for liquefying natural gas. For instance, see Finn, Adrian J., Grant L. Johnson, and Terry R. Tomlinson, "LNG Technology for Offshore and Mid-Scale Plants", Proceedings of the Seventy-Ninth Annual Convention of the Gas Processors Association, pp. 429–450, Atlanta, Ga., Mar. 13–15, 2000 and Kikkawa, Yoshitsugi, Masaaki Ohishi, and Noriyoshi Nozawa, "Optimize the Power System of Baseload LNG Plant", Proceedings of the Eightieth Annual Convention of the Gas Processors Association, San Antonio, Tex., Mar. 12–14, 2001 for surveys of a number of such processes. U.S. Pat. Nos. 4,445,917; 4,525,185; 4,545,795; 4,755,200; 5,291,736; 5,363,655; 5,365,740; 5,600,969; 5,615,561; 5,651,269; 5,755,114; 5,893,274; 6,014,869; 6,053,007; 6,062,041; 6,119,479; 6,125,653; 6,250,105 B1; 6,269,655 B1; 6,272,882 B1; 6,308,531 B1; 6,324,867 B1; 6,347,532 B1; PCT Patent Application No. WO 01/88447; and our co-pending U.S. patent application Ser. Nos. 10/161,780 filed Jun. 4, 2002 and Ser. No. 10/278,610 filed Oct. 23, 2002 also describe relevant processes. These methods generally include steps in which the natural gas is purified (by removing water and troublesome compounds such as carbon dioxide and sulfur compounds), cooled, condensed, and expanded. Cooling and condensation of the natural gas can be accomplished in many different manners. "Cascade refrigeration" employs heat exchange of the natural gas with several refrigerants having successively lower boiling points, such as propane, ethane, and methane. As an alternative, this heat exchange can be accomplished using a single refrigerant by evaporating the refrigerant at several different pressure levels. "Multi-component refrigeration" employs heat exchange of the natural gas with one or more refrigerant fluids composed of several refrigerant components in lieu of multiple single-component refrigerants. Expansion of the natural gas can be accomplished both isenthalpically (using Joule-Thomson expansion, for instance) and isentropically (using a work-expansion turbine, for instance).

Regardless of the method used to liquefy the natural gas stream, it is common to require removal of a significant fraction of the hydrocarbons heavier than methane before the methane-rich stream is liquefied. The reasons for this hydrocarbon removal step are numerous, including the need to control the heating value of the LNG stream, and the value of these heavier hydrocarbon components as products in their own right. Unfortunately, little attention has been focused heretofore on the efficiency of the hydrocarbon removal step.

In accordance with the present invention, it has been found that careful integration of the hydrocarbon removal step into the LNG liquefaction process can produce both LNG and a separate heavier hydrocarbon liquid product using significantly less energy than prior art processes. The present invention, although applicable at lower pressures, is particularly advantageous when processing feed gases in the range of 400 to 1500 psia [2,758 to 10,342 kPa(a)] or higher.

For a better understanding of the present invention, reference is made to the following examples and drawings. Referring to the drawings.

In the following explanation of the above figures, tables are provided summarizing flow rates calculated for representative process conditions. In the tables appearing herein, the values for flow rates (in moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

For convenience, process parameters are reported in both the traditional British units and in the units of the International System of Units (SI). The molar flow rates given in the tables may be interpreted as either pound moles per hour or kilogram moles per hour. The energy consumptions reported as horsepower (HP) and/or thousand British Thermal Units per hour (MBTU/Hr) correspond to the stated molar flow rates in pound moles per hour. The energy consumptions reported as kilowatts (kW) correspond to the stated molar flow rates in kilogram moles per hour. The production rates reported as pounds per hour (Lb/Hr) correspond to the stated molar flow rates in pound moles per hour. The production rates reported as kilograms per hour (kg/Hr) correspond to the stated molar flow rates in kilogram moles per hour.

DESCRIPTION OF THE INVENTION

Figure 1:
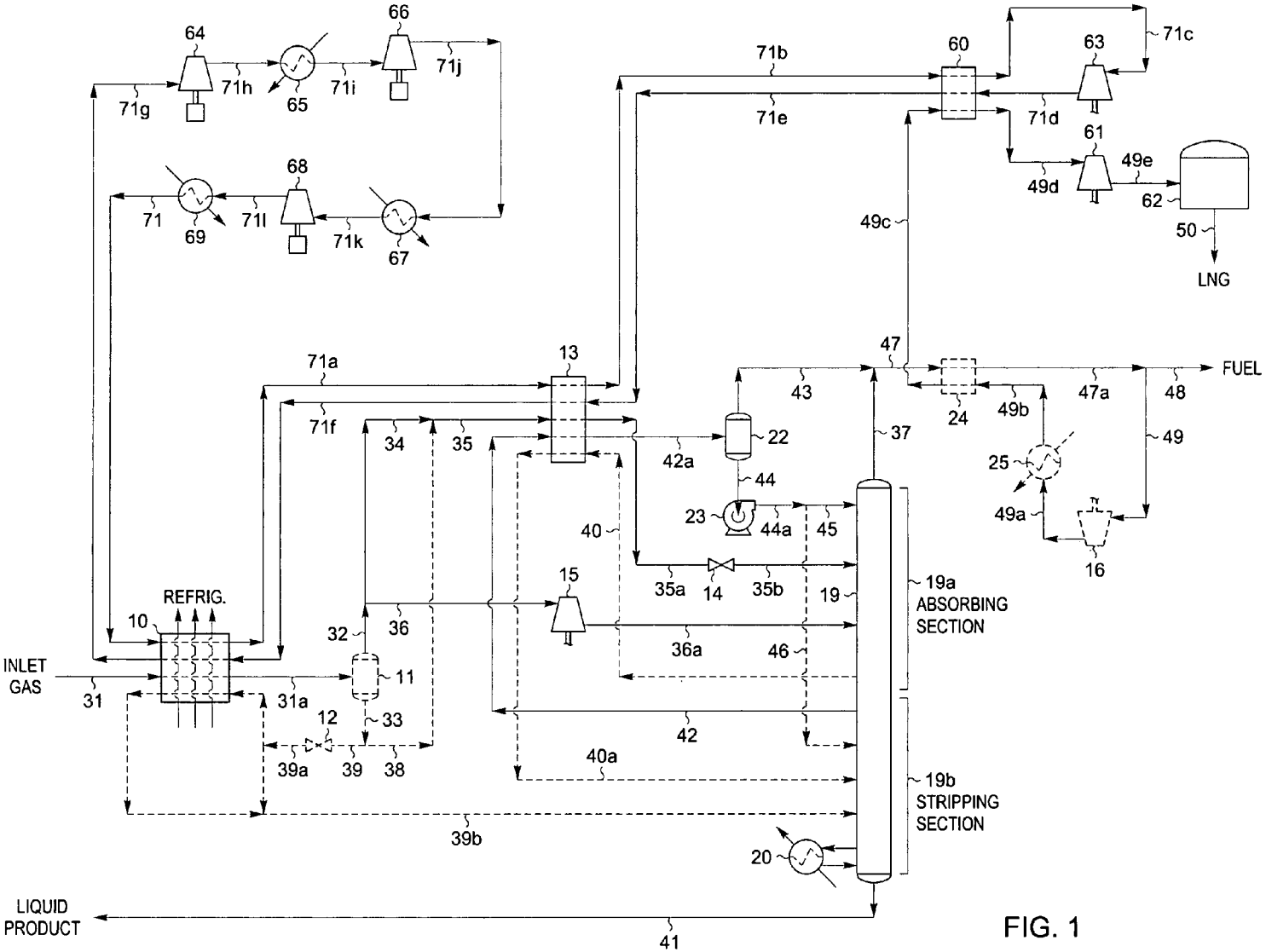
FIG. 1 is a flow diagram of a natural gas liquefaction plant adapted for co-production of NGL in accordance with the present invention.

Referring now to FIG. 1, we begin with an illustration of a process in accordance with the present invention where it is desired to produce an NGL co-product containing about one-half of the ethane and the majority of the propane and heavier components in the natural gas feed stream. In this simulation of the present invention, inlet gas enters the plant at 90° F. [32° C.] and 1285 psia [8,860 kPa(a)] as stream 31. If the inlet gas contains a concentration of carbon dioxide and/or sulfur compounds which would prevent the product streams from meeting specifications, these compounds are removed by appropriate pretreatment of the feed gas (not illustrated). In addition, the feed stream is usually dehydrated to prevent hydrate (ice) formation under cryogenic conditions. Solid desiccant has typically been used for this purpose.

The feed stream 31 is cooled in heat exchanger 10 by heat exchange with refrigerant streams and flashed separator liquids at −44° F. [−42° C.] (stream 39*a*). Note that in all cases heat exchanger 10 is representative of either a multitude of individual heat exchangers or a single multi-pass heat exchanger, or any combination thereof. (The decision as to whether to use more than one heat exchanger for the indicated cooling services will depend on a number of factors including, but not limited to, inlet gas flow rate, heat exchanger size, stream temperatures, etc.) The cooled stream 31*a* enters separator 11 at 0° F. [−18° C.] and 1278 psia [8,812 kPa(a)] where the vapor (stream 32) is separated from the condensed liquid (stream 33).

The vapor (stream 32) from separator 11 is divided into two streams, 34 and 36, with stream 34 containing about 15% of the total vapor. Some circumstances may favor combining stream 34 with some portion of the condensed liquid (stream 38) to form combined stream 35, but in this simulation there is no flow in stream 38. Stream 35 passes through heat exchanger 13 in heat exchange relation with refrigerant stream 71*e* and liquid distillation stream 40, resulting in cooling and substantial condensation of stream 35*a*. The substantially condensed stream 35*a* at −109° F. [−78° C.] is then flash expanded through an appropriate expansion device, such as expansion valve 14, to the operating pressure (approximately 465 psia [3,206 kPa(a)]) of fractionation tower 19. During expansion a portion of the stream is vaporized, resulting in cooling of the total stream. In the process illustrated in FIG. 1, the expanded stream 35*b* leaving expansion valve 14 reaches a temperature of −125° F. [−87° C.] and is then supplied at an upper mid-point feed position in absorbing section 19*a* of fractionation tower 19.

The remaining 85% of the vapor from separator 11 (stream 36) enters a work expansion machine 15 in which mechanical, energy is extracted from this portion of the high pressure feed. The machine 15 expands the vapor substantially isentropically to the tower operating pressure, with the work expansion cooling the expanded stream 36*a* to a temperature of approximately −76° F. [−60° C.]. The typical commercially available expanders are capable of recovering on the order of 80–85% of the work theoretically available in an ideal isentropic expansion. The work recovered is often used to drive a centrifugal compressor (such as item 16) that can be used to re-compress the tower overhead gas (stream 49), for example. The expanded and partially condensed stream 36*a* is supplied as feed to absorbing section 19*a* in distillation column 19 at a lower mid-column feed point. Stream 39, the remaining portion of the separator liquid (stream 33) is flash expanded to slightly above the operating pressure of demethanizer 19 by expansion valve 12, cooling stream 39 to −44° F. [−42° C.] (stream 39*a*) before it provides cooling to the incoming feed gas as described earlier. Stream 39*b*, now at 85° F. [29° C.], then enters stripping section 19*b* in demethanizer 19 at a second lower mid-column feed point.

The demethanizer in fractionation tower 19 is a conventional distillation column containing a plurality of vertically spaced trays, one or more packed beds, or some combination of trays and packing. As is often the case in natural gas processing plants, the fractionation tower may consist of two sections. The upper absorbing (rectification) section 19*a* contains the trays and/or packing to provide the necessary contact between the vapor portion of the expanded stream 36*a* rising upward and cold liquid falling downward to condense and absorb the ethane, propane, and heavier components; and the lower, stripping section 19*b* contains the trays and/or packing to provide the necessary contact between the liquids falling downward and the vapors rising upward. The stripping section also includes one or more reboilers (such as reboiler 20) which heat and vaporize a portion of the liquids flowing down the column to provide the stripping vapors which flow up the column to strip the liquid product, stream 41, of methane and lighter components. The liquid product stream 41 exits the bottom of demethanizer 19 at 150° F. [66° C.], based on a typical specification of a methane to ethane ratio of 0.020:1 on a molar basis in the bottom product. The overhead distillation vapor stream 37, containing predominantly methane and lighter components, leaves the top of demethanizer 19 at −108° F. [−78° C.].

A portion of the distillation vapor (stream 42) is withdrawn from the upper region of stripping section 19*b*. This stream is cooled from −58° F. [−50° C.] to −109° F. [−78° C.]and partially condensed (stream 42*a*) in heat exchanger 13 by heat exchange with refrigerant stream 71*e* and liquid distillation stream 40. The operating pressure in reflux separator 22 (461 psia [3,182 kPa(a)]) is maintained slightly below the operating pressure of demethanizer 19. This provides the driving force which causes distillation vapor stream 42 to flow through heat exchanger 13 and thence into the reflux separator 22 wherein the condensed liquid (stream 44) is separated from any uncondensed vapor (stream 43). Stream 43 combines with the distillation vapor stream (stream 37) leaving the upper region of absorbing section 19*a* of demethanizer 19 to form cold residue gas stream 47 at −108° F. [−78° C.].

The condensed liquid (stream 44) is pumped to higher pressure by pump 23, whereupon stream 44*a* at −109° F. [−78° C.] is divided into two portions. One portion, stream 45, is routed to the upper region of absorbing section 19*a* of demethanizer 19 to serve as the cold liquid that contacts the vapors rising upward through the absorbing section. The other portion is supplied to the upper region of stripping section 19*b* of demethanizer 19 as reflux stream 46.

Liquid distillation stream 40 is withdrawn from a lower region of absorbing section 19*a* of demethanizer 19 and is routed to heat exchanger 13 where it is heated as it provides cooling of distillation vapor stream 42, combined stream 35, and refrigerant (stream 71*a*). The liquid distillation stream is heated from −79° F. [−62° C.] to −20° F. [−29° C.], partially vaporizing stream 40*a* before it is supplied as a mid-column feed to stripping section 19*b* in demethanizer 19.

The cold residue gas (stream 47) is warmed to 94° F. [34° C.] in heat exchanger 24, and a portion (stream 48) is then withdrawn to serve as fuel gas for the plant. (The amount of fuel gas that must be withdrawn is largely determined by the fuel required for the engines and/or turbines driving the gas compressors in the plant, such as refrigerant compressors 64, 66, and 68 in this example.) The remainder of the warmed residue gas (stream 49) is compressed by compressor 16 driven by expansion machines 15, 61, and 63. After cooling to 100° F. [38° C.] in discharge cooler 25, stream 49*b* is further cooled to −93° F. [−69° C.] (stream 49*c*) in heat exchanger 24 by cross exchange with cold residue gas stream 47.

Stream 49*c* then enters heat exchanger 60 and is further cooled by expanded refrigerant stream 71*d* to −256° F. [−160° C.] to condense and subcool it, whereupon it enters a work expansion machine 61 in which mechanical energy is extracted from the stream. The machine 61 expands liquid stream 49*d* substantially isentropically from a pressure of about 638 psia [4,399 kPa(a)] to the LNG storage pressure (15.5 psia [107 kPa(a)]), slightly above atmospheric pressure. The work expansion cools the expanded stream 49*e* to a temperature of approximately −257° F. [−160° C.], whereupon it is then directed to the LNG storage tank 62 which holds the LNG product (stream 50).

All of the cooling for stream 49*c* and a portion of the cooling for streams 35 and 42 is provided by a closed cycle refrigeration loop. The working fluid for this refrigeration cycle is a mixture of hydrocarbons and nitrogen, with the composition of the mixture adjusted as needed to provide the required refrigerant temperature while condensing at a reasonable pressure using the available cooling medium. In this case, condensing with cooling water has been assumed, so a refrigerant mixture composed of nitrogen, methane, ethane, propane, and heavier hydrocarbons is used in the simulation of the FIG. 1 process. The composition of the stream, in approximate mole percent, is 6.9% nitrogen, 40.8% methane, 37.8% ethane, and 8.2% propane, with the balance made up of heavier hydrocarbons.

The refrigerant stream 71 leaves discharge cooler 69 at 100° F. [38° C.] and 607 psia [4,185 kPa(a)]. It enters heat exchanger 10 and is cooled to −15° F. [−26° C.] and partially condensed by the partially warmed expanded refrigerant stream 71*f* and by other refrigerant streams. For the FIG. 1 simulation, it has been assumed that these other refrigerant streams are commercial-quality propane refrigerant at three different temperature and pressure levels. The partially condensed refrigerant stream 71*a* then enters heat exchanger 13 for further cooling to −109° F. [−78° C.] by partially warmed expanded refrigerant stream 71*e*, further condensing the refrigerant (stream 71*b*). The refrigerant is condensed and then subcooled to −256° F. [−160° C.] in heat exchanger 60 by expanded refrigerant stream 71*d*. The subcooled liquid stream 71*c* enters a work expansion machine 63 in which mechanical energy is extracted from the stream as it is expanded substantially isentropically from a pressure of about 586 psia [4,040 kPa(a)] to about 34 psia [234 kPa(a)]. During expansion a portion of the stream is vaporized, resulting in cooling of the total stream to −262° F. [−163° C.] (stream 71*d*). The expanded stream 71*d* then reenters heat exchangers 60, 13, and 10 where it provides cooling to stream 49*c*, stream 35, stream 42, and the refrigerant (streams 71, 71*a*, and 71*b*) as it is vaporized and superheated.

The superheated refrigerant vapor (stream 71*g*) leaves heat exchanger 10 at 93° F. [34° C.] and is compressed in three stages to 617 psia [4,254 kPa(a)]. Each of the three compression stages (refrigerant compressors 64, 66, and 68) is driven by a supplemental power source and is followed by a cooler (discharge coolers 65, 67, and 69) to remove the heat of compression. The compressed stream 71 from discharge cooler 69 returns to heat exchanger 10 to complete the cycle.

A summary of stream flow rates and energy consumption for the process illustrated in FIG. 1 is set forth in the following table:

TABLE I (FIG. 1)
Stream Flow Summary - Lb. Moles/Hr [kg moles/Hr]

| Stream | Methane | Ethane | Propane | Butanes+ | Total |
|---|---|---|---|---|---|
| 31 | 40,977 | 3,861 | 2,408 | 1,404 | 48,656 |
| 32 | 38,538 | 3,336 | 1,847 | 830 | 44,556 |
| 33 | 2,439 | 525 | 561 | 574 | 4,100 |
| 34 | 5,781 | 501 | 277 | 125 | 6,683 |
| 36 | 32,757 | 2,835 | 1,570 | 705 | 37,873 |
| 40 | 3,896 | 2,170 | 1,847 | 829 | 8,742 |
| 42 | 8,045 | 1,850 | 26 | 0 | 9,922 |
| 43 | 4,551 | 240 | 1 | 0 | 4,792 |
| 44 | 3,494 | 1,610 | 25 | 0 | 5,130 |
| 45 | 1,747 | 805 | 12 | 0 | 2,565 |
| 46 | 1,747 | 805 | 13 | 0 | 2,565 |
| 37 | 36,393 | 1,970 | 11 | 0 | 38,380 |
| 41 | 33 | 1,651 | 2,396 | 1,404 | 5,484 |
| 47 | 40,944 | 2,210 | 12 | 0 | 43,172 |
| 48 | 2,537 | 137 | 1 | 0 | 2,676 |
| 50 | 38,407 | 2,073 | 11 | 0 | 40,496 |

| | | | | |
|---|---|---|---|---|
| Recoveries in NGL* | | | | |
| Ethane | 42.75% | | | |
| Propane | 99.53% | | | |
| Butanes+ | 100.00% | | | |
| Production Rate | 246,263 | Lb/Hr | [246,263 | kg/Hr] |
| LNG Product | | | | |
| Production Rate | 679,113 | Lb/Hr | [679,113 | kg/Hr] |
| Purity* | 94.84% | | | |
| Lower Heating Value | 946.0 | BTU/SCF | [35.25 | MJ/m$^3$] |
| Power | | | | |
| Refrigerant Compression | 94,868 | HP | [155,962 | kW] |
| Propane Compression | 25,201 | HP | [41,430 | kW] |
| Total Compression | 120,069 | HP | [197,392 | kW] |
| Utility Heat | | | | |
| Demethanizer Reboiler | 24,597 | MBTU/Hr | [15,888 | kW] |

*(Based on un-rounded flow rates)

The efficiency of LNG production processes is typically compared using the "specific power consumption" required, which is the ratio of the total refrigeration compression power to the total liquid production rate. Published information on the specific power consumption for prior art processes for producing LNG indicates a range of 0.168 HP-Hr/Lb [0.276 kW-Hr/kg] to 0.182 HP-Hr/Lb [0.300 kW-Hr/kg], which is believed to be based on an on-stream factor of 340 days per year for the LNG production plant. On this same basis, the specific power consumption for the FIG. 1 embodiment of the present invention is 0.139 HP-Hr/Lb [0.229 kW-Hr/kg], which gives an efficiency improvement of 21–31% over the prior art processes.

Figure 2:
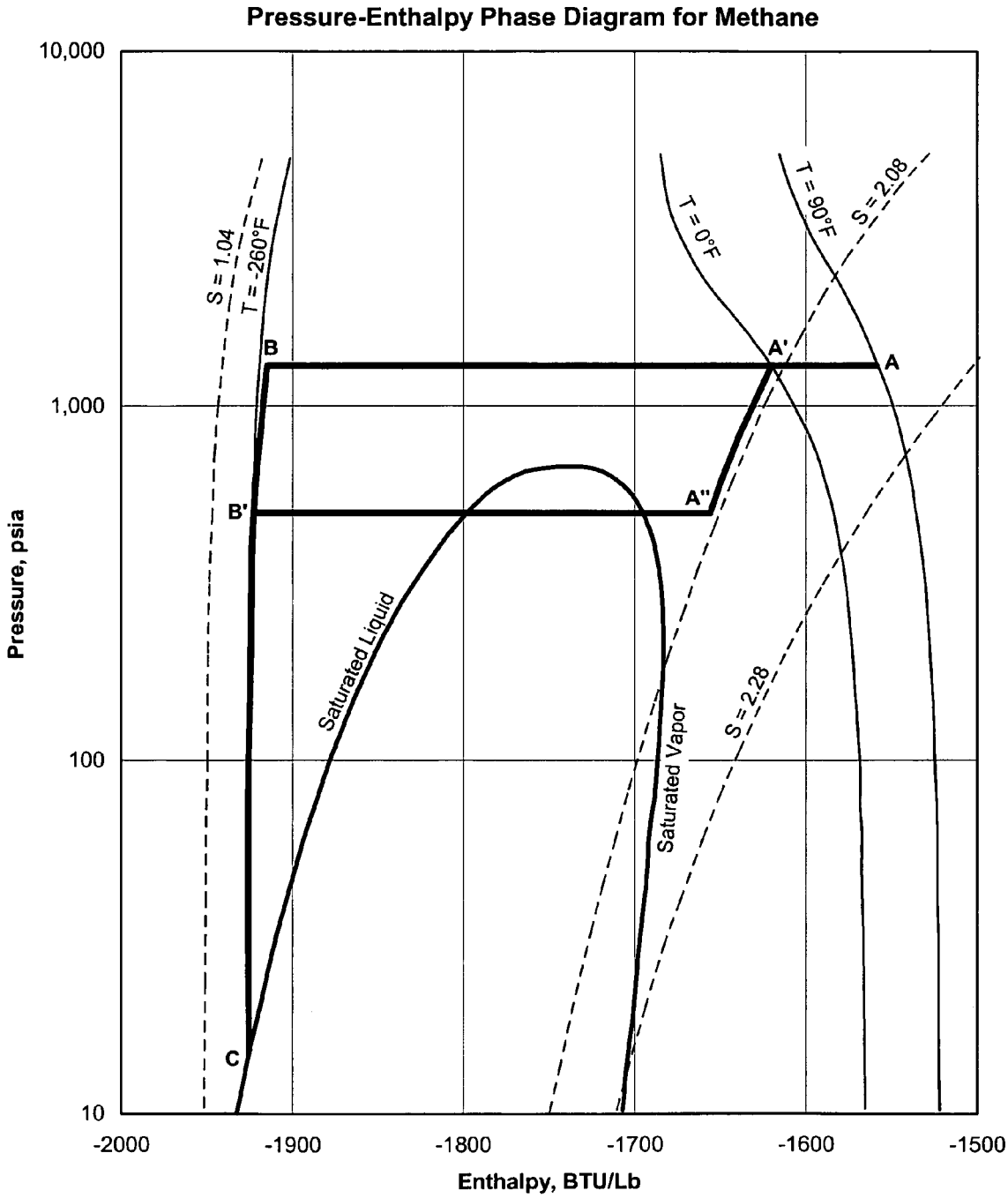
FIG. 2 is a pressure-enthalpy phase diagram for methane used to illustrate the advantages of the present invention over prior art processes.

There are two primary factors that account for the improved efficiency of the present invention. The first factor can be understood by examining the thermodynamics of the liquefaction process when applied to a high pressure gas stream such as that considered in this example. Since the primary constituent of this stream is methane, the thermodynamic properties of methane can be used for the purposes of comparing the liquefaction cycle employed in the prior art processes versus the cycle used in the present invention. FIG. 2 contains a pressure-enthalpy phase diagram for methane. In most of the prior art liquefaction cycles, all cooling of the gas stream is accomplished while the stream is at high pressure (path A–B), whereupon the stream is then expanded (path B–C) to the pressure of the LNG storage vessel (slightly above atmospheric pressure). This expansion step may employ a work expansion machine, which is typically capable of recovering on the order of 75–80% of the work theoretically available in an ideal isentropic expansion. In the interest of simplicity, fully isentropic expansion is displayed in FIG. 2 for path B–C. Even so, the enthalpy reduction provided by this work expansion is quite small, because the lines of constant entropy are nearly vertical in the liquid region of the phase diagram.

Contrast this now with the liquefaction cycle of the present invention. After partial cooling at high pressure (path A–A'), the gas stream is work expanded (path A'–A") to an intermediate pressure. (Again, fully isentropic expansion is displayed in the interest of simplicity.) The remainder of the cooling is accomplished at the intermediate pressure (path A"–B'), and the stream is then expanded (path B'–C) to the pressure of the LNG storage vessel. Since the lines of constant entropy slope less steeply in the vapor region of the phase diagram, a significantly larger enthalpy reduction is provided by the first work expansion step (path A'–A") of the present invention. Thus, the total amount of cooling required for the present invention (the sum of paths A–A' and A"–B') is less than the cooling required for the prior art processes (path A–B), reducing the refrigeration (and hence the refrigeration compression) required to liquefy the gas stream.

The second factor accounting for the improved efficiency of the present invention is the superior performance of hydrocarbon distillation systems at lower operating pressures. The hydrocarbon removal step in most of the prior art processes is performed at high pressure, typically using a scrub column that employs a cold hydrocarbon liquid as the absorbent stream to remove the heavier hydrocarbons from the incoming gas stream. Operating the scrub column at high pressure is not very efficient, as it results in the co-absorption of a significant fraction of the methane from the gas stream, which must subsequently be stripped from the absorbent liquid and cooled to become part of the LNG product. In the present invention, the hydrocarbon removal step is conducted at the intermediate pressure where the vapor-liquid equilibrium is much more favorable, resulting in very efficient recovery of the desired heavier hydrocarbons in the co-product liquid stream.

Other Embodiments

One skilled in the art will recognize that the present invention can be adapted for use with all types of LNG liquefaction plants to allow co-production of an NGL stream, an LPG stream, or a condensate stream, as best suits the needs at a given plant location. Further, it will be recognized that a variety of process configurations may be employed for recovering the liquid co-product stream. The present invention can be adapted to recover an NGL stream containing a significantly higher fraction of the $C_2$ components present in the feed gas, to recover an LPG stream containing only the $C_3$ and heavier components present in the feed gas, or to recover a condensate stream containing only the $C_4$ and heavier components present in the feed gas, rather than producing an NGL co-product containing only a moderate fraction of the $C_2$ components as described earlier. The present invention is particularly advantageous over the prior art processes when only partial recovery of the $C_2$ components in the feed gas is desired while capturing essentially all of the $C_3$ and heavier components, as the reflux stream 45 in the FIG. 1 embodiment allows maintaining very high $C_3$ component recovery regardless of the $C_2$ component recovery level.

In accordance with this invention, it is generally advantageous to design the absorbing (rectification) section of the demethanizer to contain multiple theoretical separation stages. However, the benefits of the present invention can be achieved with as few as one theoretical stage, and it is believed that even the equivalent of a fractional theoretical stage may allow achieving these benefits. For instance, all or a part of the pumped condensed liquid (stream 44*a*) leaving reflux separator 22 and all or a part of the expanded substantially condensed stream 35*b* from expansion valve 14 can be combined (such as in the piping joining the expansion valve to the demethanizer) and if thoroughly intermingled, the vapors and liquids will mix together and separate in accordance with the relative volatilities of the various components of the total combined streams. Such commingling of the two streams shall be considered for the purposes of this invention as constituting an absorbing section.

FIG. 1 represents the preferred embodiment of the present invention for the processing conditions indicated. FIGS. 3 through 8 depict alternative embodiments of the present invention that may be considered for a particular application. Depending on the quantity of heavier hydrocarbons in the feed gas and the feed gas pressure, the cooled feed stream 31*a* leaving heat exchanger 10 may not contain any liquid (because it is above its dewpoint, or because it is above its cricondenbar). In such cases, separator 11 shown in FIGS. 1 and 3 through 8 is not required, and the cooled feed stream can be divided into streams 34 and 36, which then can flow to heat exchange (stream 34) and to an appropriate expansion device (stream 36), such as work expansion machine 15.

Figure 3:
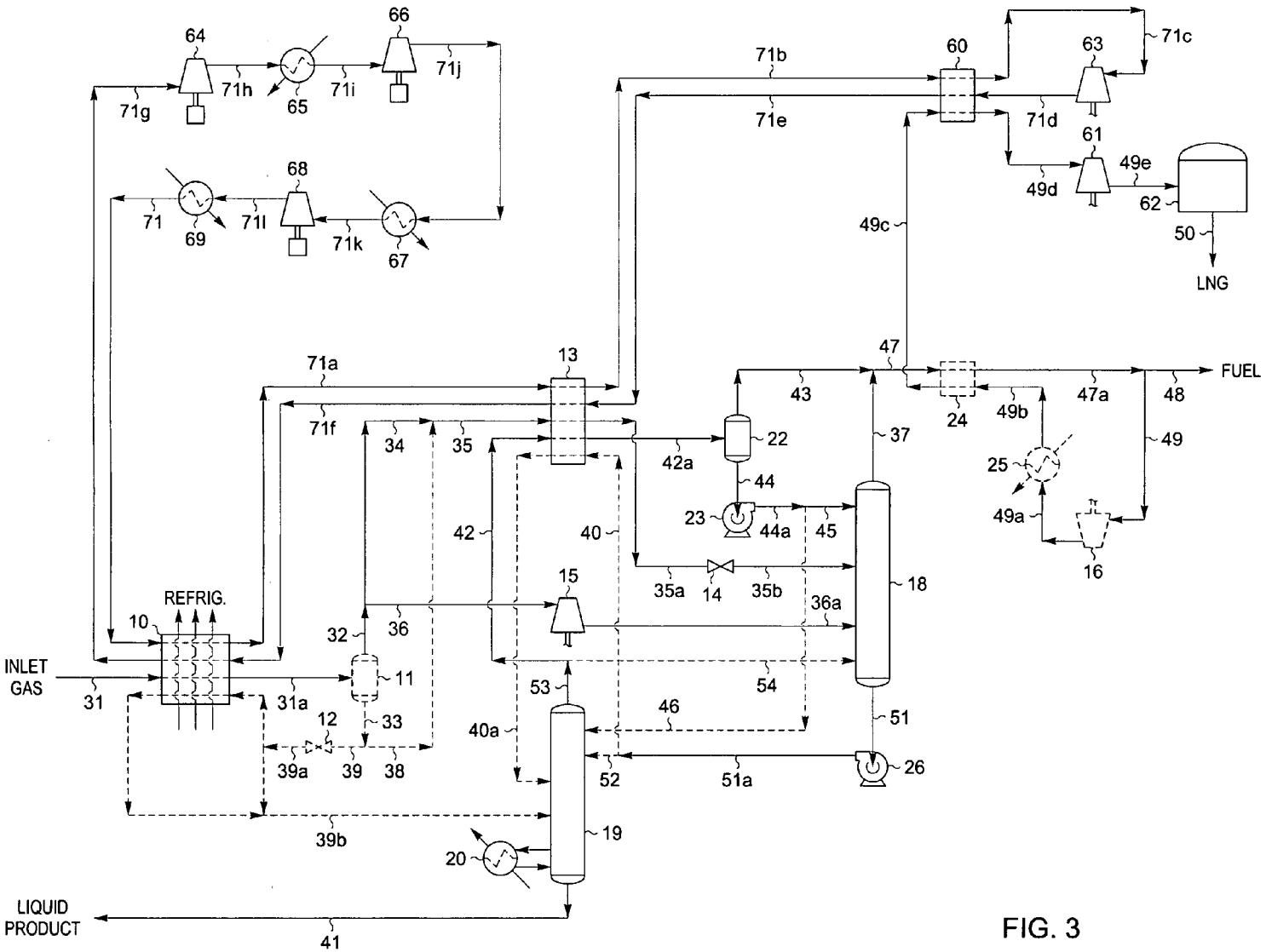
FIGS. 3, 4, 5, 6, 7, and 8 are flow diagrams of alternative natural gas liquefaction plants adapted for co-production of a liquid stream in accordance with the present invention.

As described earlier, the distillation vapor stream 42 is partially condensed and the resulting condensate used to absorb valuable $C_3$ components and heavier components from the vapors rising through absorbing section 19*a* of demethanizer 19 (FIGS. 1 and 4 through 8) or absorber column 18 (FIG. 3). However, the present invention is not limited to this embodiment. It may be advantageous, for instance, to treat only a portion of these vapors in this manner, or to use only a portion of the condensate as an absorbent, in cases where other design considerations indicate portions of the vapors or the condensate should bypass absorbing section 19*a* of demethanizer 19. Some circumstances may favor total condensation, rather than partial condensation, of distillation stream 42 in heat exchanger 13. Other circumstances may favor that distillation stream 42 be a total vapor side draw from fractionation column 19 rather than a partial vapor side draw.

In the practice of the present invention, there will necessarily be a slight pressure difference between demethanizer 19 and reflux separator 22 which must be taken into account. If the distillation vapor stream 42 passes through heat exchanger 13 and into reflux separator 22 without any boost in pressure, the reflux separator shall necessarily assume an operating pressure slightly below the operating pressure of demethanizer 19. In this case, the liquid stream withdrawn from the reflux separator can be pumped to its feed position(s) in the demethanizer. An alternative is to provide a booster blower for distillation vapor stream 42 to raise the operating pressure in heat exchanger 13 and reflux separator 22 sufficiently so that the liquid stream 44 can be supplied to demethanizer 19 without pumping.

The high pressure liquid (stream 33 in FIGS. 1 and 3 through 8) need not be expanded and fed to a mid-column feed point on the distillation column. Instead, all or a portion of it may be combined with the portion of the separator vapor (stream 34) flowing to heat exchanger 13. (This is shown by the dashed stream 38 in FIGS. 1 and 3 through 8.) Any remaining portion of the liquid may be expanded through an appropriate expansion device, such as an expansion valve or expansion machine, and fed to a mid-column feed point on the distillation column (stream 39*b* in FIGS. 1 and 3 through 8). Stream 39 in FIGS. 1 and 3 through 8 may also be used for inlet gas cooling or other heat exchange service before or after the expansion step prior to flowing to the demethanizer, similar to what is shown by the dashed stream 39*a* in FIGS. 1 and 3 through 8.

In accordance with this invention, the splitting of the vapor feed may be accomplished in several ways. In the processes of FIGS. 1 and 3 through 8, the splitting of vapor occurs following cooling and separation of any liquids which may have been formed. The high pressure gas may be split, however, prior to any cooling of the inlet gas or after the cooling of the gas and prior to any separation stages. In some embodiments, vapor splitting may be effected in a separator.

FIG. 3 depicts a fractionation tower constructed in two vessels, absorber column 18 and stripper column 19. In such cases, the overhead vapor (stream 53) from stripper column 19 may be split into two portions. One portion (stream 42) is routed to heat exchanger 13 to generate reflux for absorber column 18 as described earlier. Any remaining portion (stream 54) flows to the lower section of absorber column 18 to be contacted by expanded substantially condensed stream 35*b* and reflux liquid (stream 45). Pump 26 is used to route the liquids (stream 51) from the bottom of absorber column 18 to the top of stripper column 19 so that the two towers effectively function as one distillation system. The decision whether to construct the fractionation tower as a single vessel (such as demethanizer 19 in FIGS. 1 and 4 through 8) or multiple vessels will depend on a number of factors such as plant size, the distance to fabrication facilities, etc.

Some circumstances may favor withdrawing all of the cold liquid distillation stream 40 leaving absorbing section 19*a* in FIGS. 1 and 4 through 8 or absorber column 18 in FIG. 3 for heat exchange, while other circumstances may not favor withdrawing and using stream 40 for heat exchange at all, so stream 40 in FIGS. 1 and 3 through 8 is shown dashed. Although only a portion of the liquid from absorbing section 19*a* can be used for process heat exchange when operating the present invention to recover a large fraction of the ethane in the feed gas without reducing the ethane recovery in demethanizer 19, more duty can sometimes be obtained from these liquids than with a conventional side reboiler using liquids from stripping section 19*b*. This is because the liquids in absorbing section 19*a* of demethanizer 19 are available at a colder temperature level than those in stripping section 19*b*. This same feature can be accomplished when fractionation tower 19 is constructed as two vessels, as shown by dashed stream 40 in FIG. 3. When the liquids from absorber column 18 are pumped as in FIG. 3, the liquid (stream 51*a*) leaving pump 26 can be split into two portions, with one portion (stream 40) used for heat exchange and then routed to a mid-column feed position on stripper column 19 (stream 40*a*). Any remaining portion (stream 52) becomes the top feed to stripper column 19. As shown by dashed stream 46 in FIGS. 1 and 3 through 8, in such cases it may be advantageous to split the liquid stream from reflux pump 23 (stream 44*a*) into at least two streams so that a portion (stream 46) can be supplied to the stripping section of fractionation tower 19 (FIGS. 1 and 4 through 8) or to stripper column 19 (FIG. 3) to increase the liquid flow in that part of the distillation system and improve the rectification of stream 42, while the remaining portion (stream 45) is supplied to the top of absorbing section 19*a* (FIGS. 1 and 4 through 8) or to the top of absorber column 18 (FIG. 3).

Figure 4:
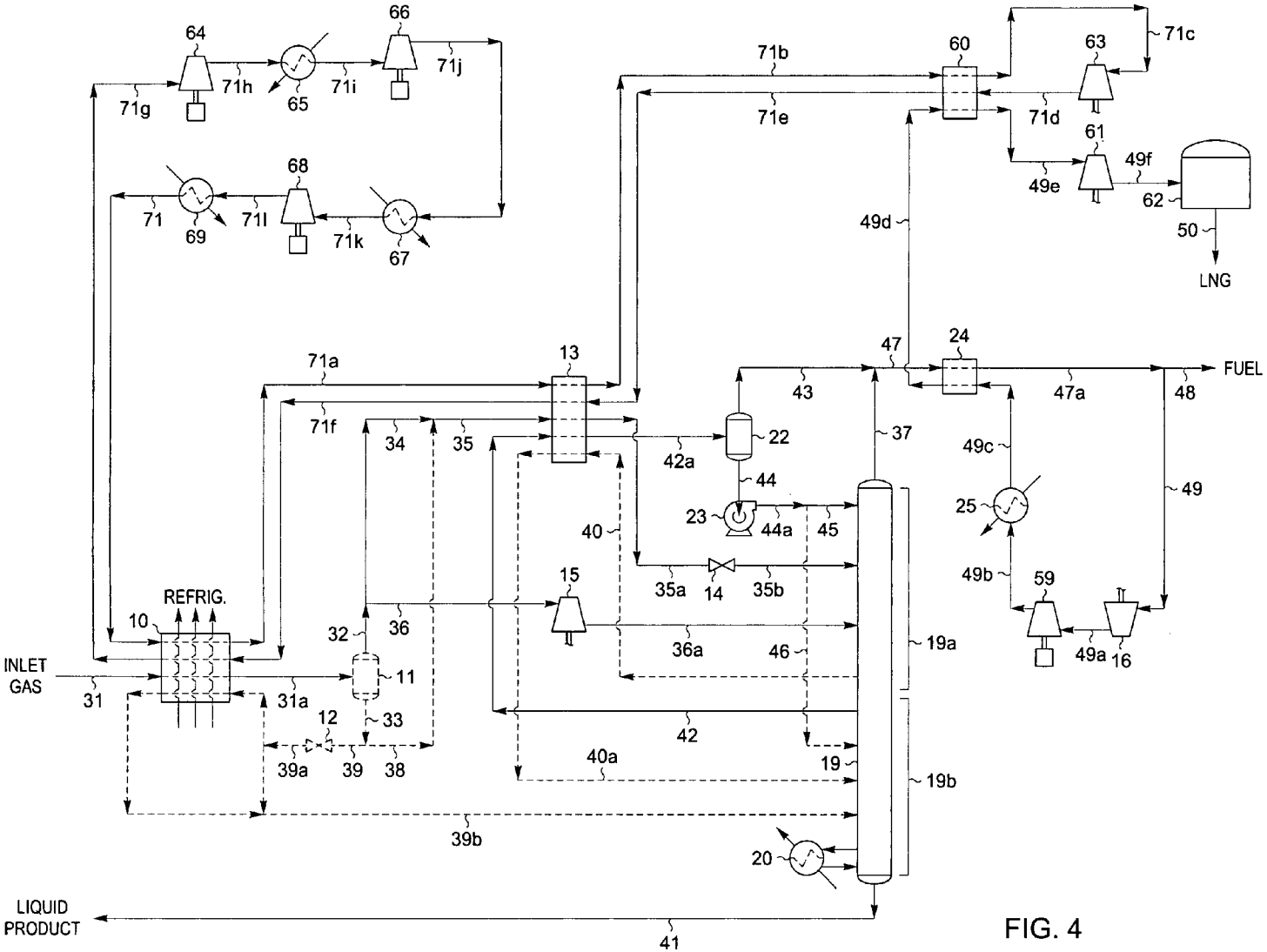
Figure 5:
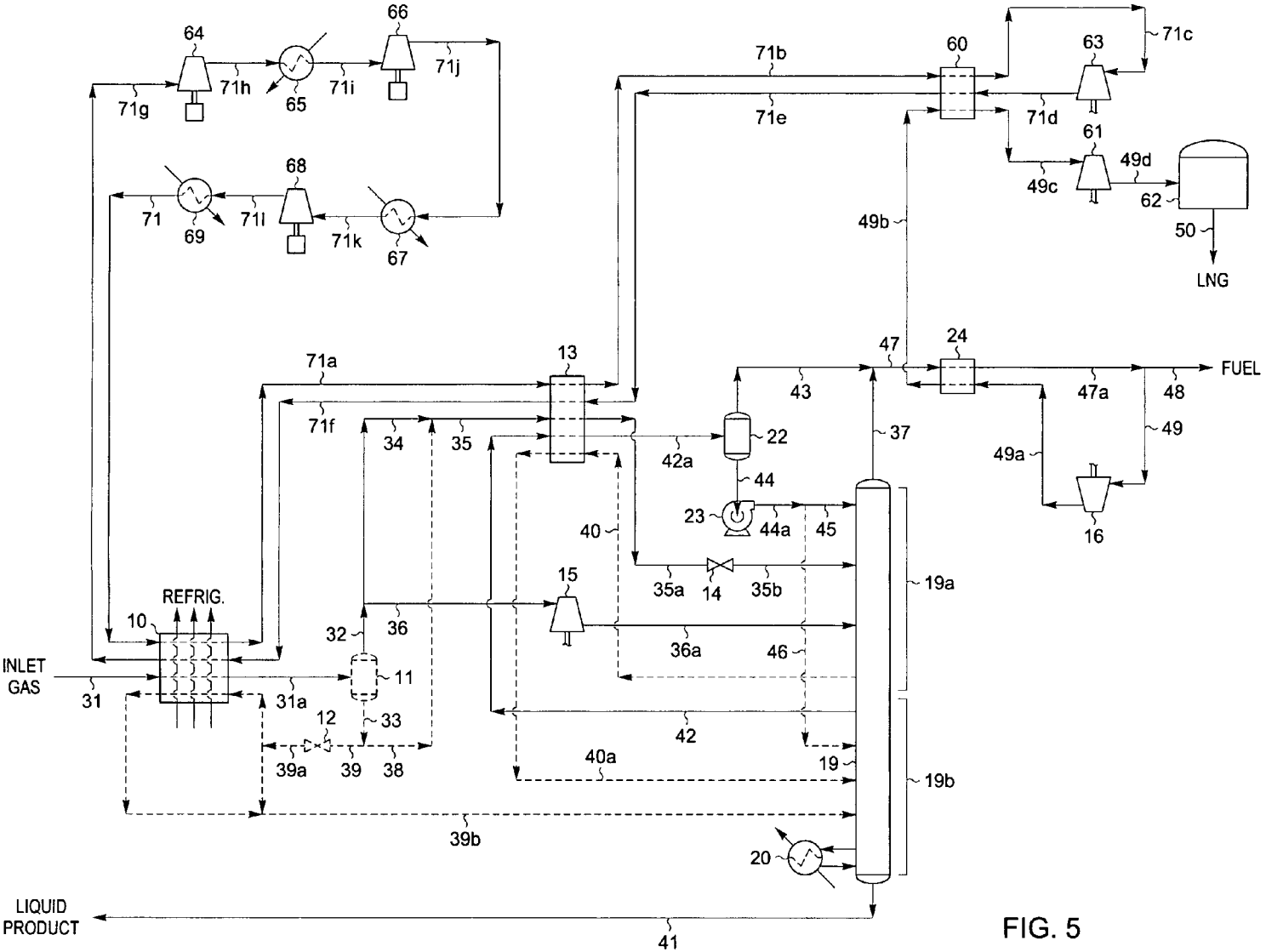
Figure 6:
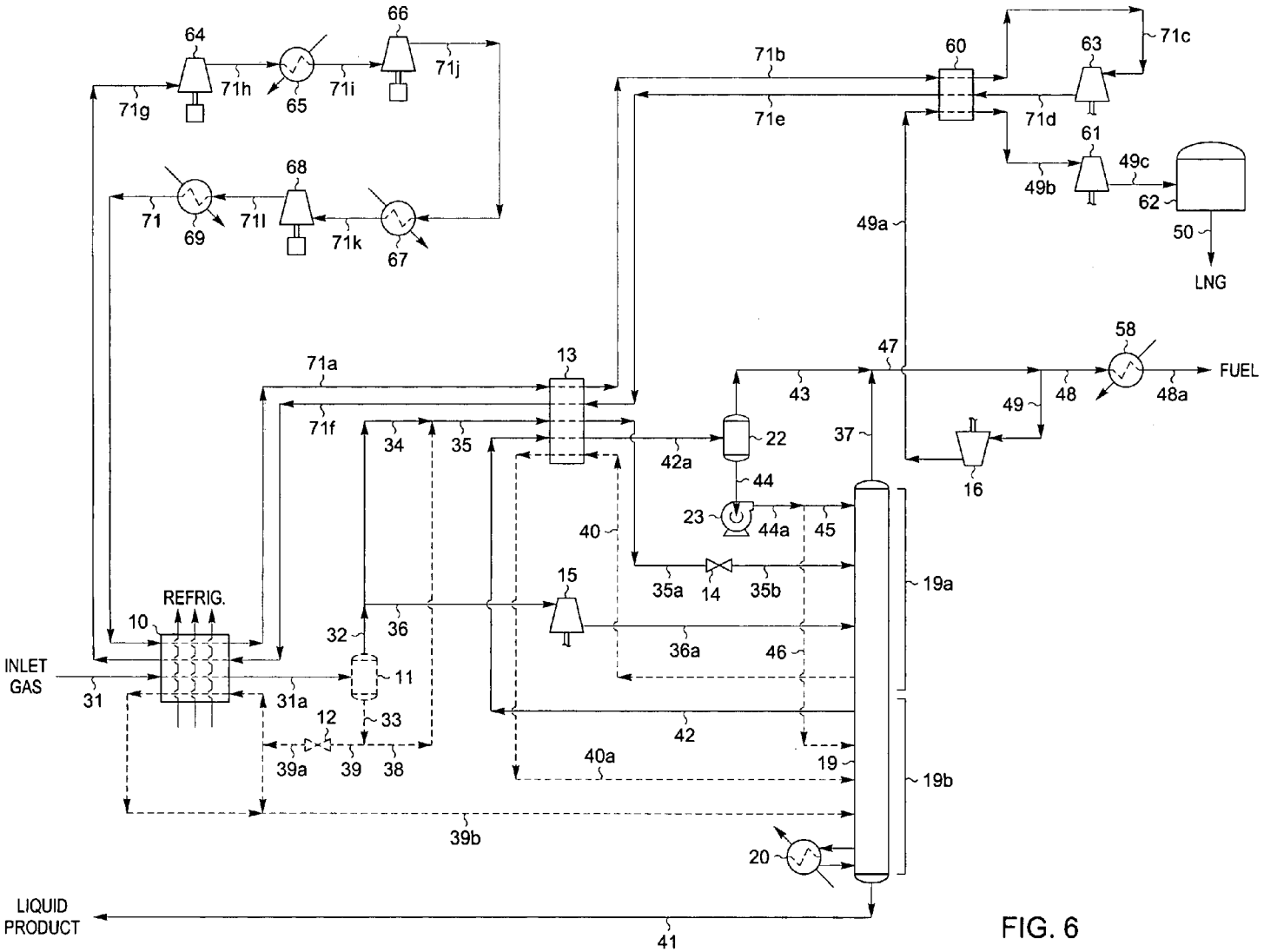
Figure 7:
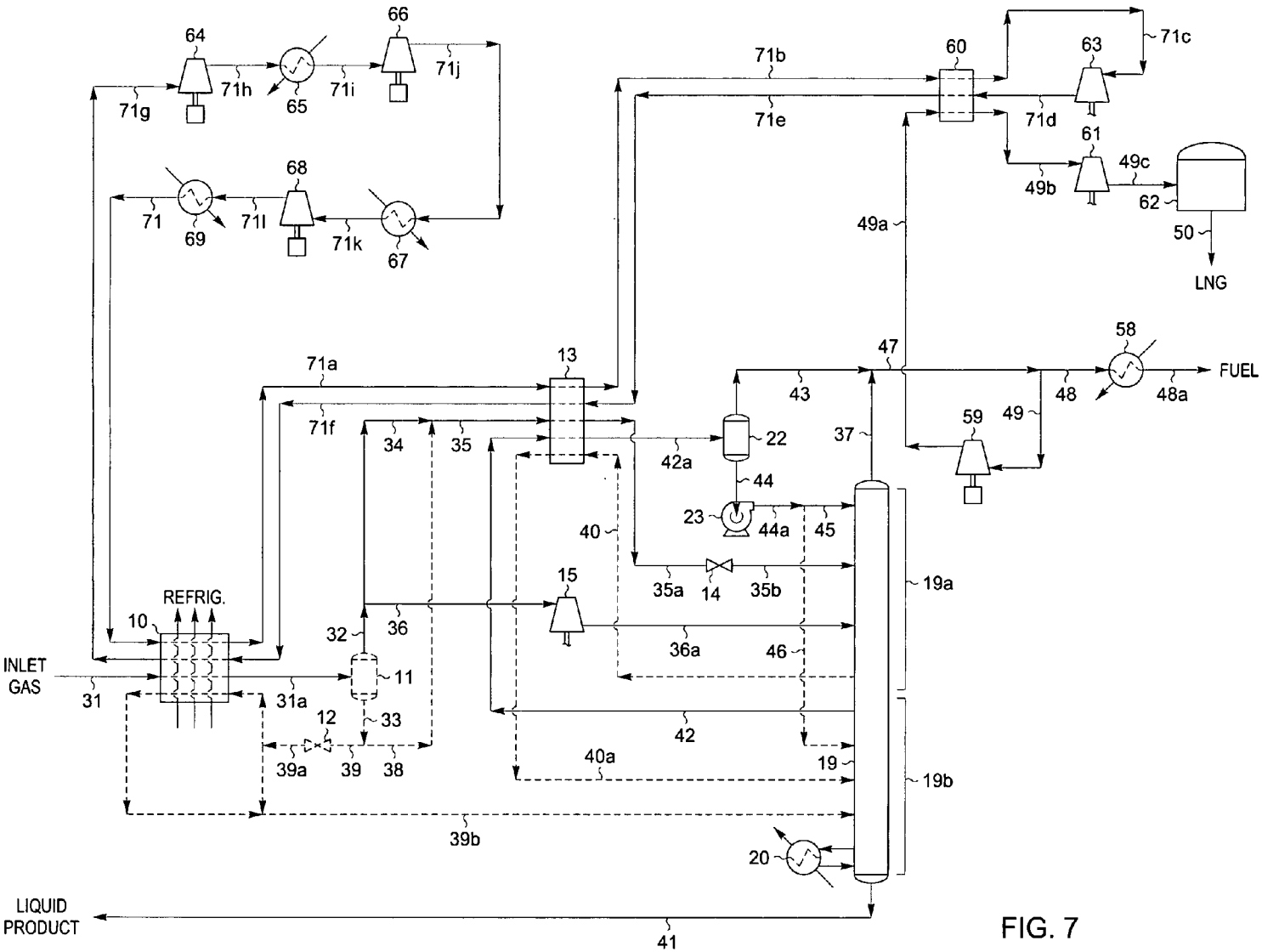
Figure 8:
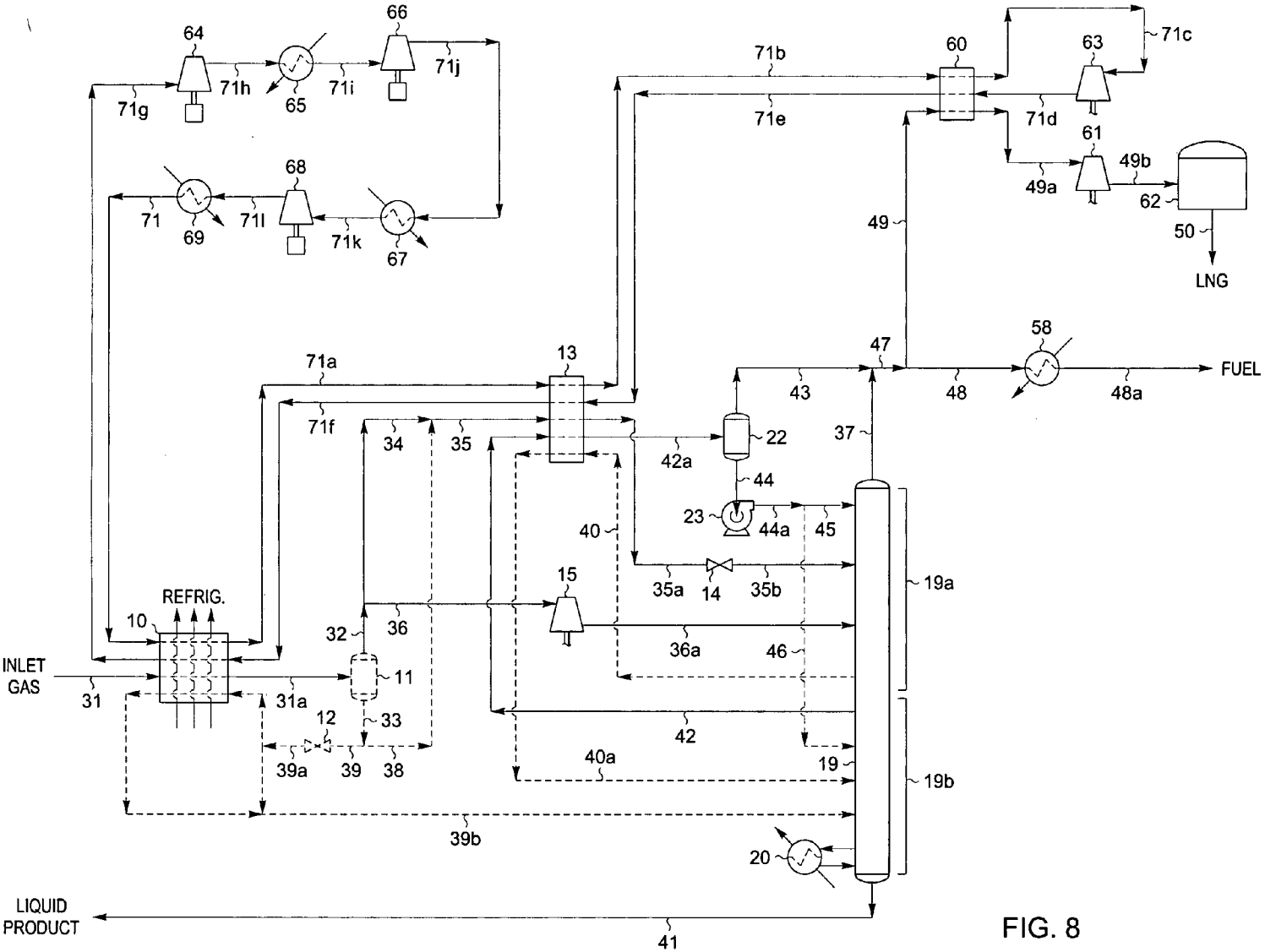

The disposition of the gas stream remaining after recovery of the liquid co-product stream (stream 47 in FIGS. 1 and 3 through 8) before it is supplied to heat exchanger 60 for condensing and subcooling may be accomplished in many ways. In the process of FIG. 1, the stream is heated, compressed to higher pressure using energy derived from one or more work expansion machines, partially cooled in a discharge cooler, then further cooled by cross exchange with the original stream. As shown in FIG. 4, some applications may favor compressing the stream to higher pressure, using supplemental compressor 59 driven by an external power source for example. As shown by the dashed equipment (heat exchanger 24 and discharge cooler 25) in FIG. 1, some circumstances may favor reducing the capital cost of the facility by reducing or eliminating the pre-cooling of the compressed stream before it enters heat exchanger 60 (at the expense of increasing the cooling load on heat exchanger 60 and increasing the power consumption of refrigerant compressors 64, 66, and 68). In such cases, stream 49*a* leaving the compressor may flow directly to heat exchanger 24 as shown in FIG. 5, or flow directly to heat exchanger 60 as shown in FIG. 6. If work expansion machines are not used for expansion of any portions of the high pressure feed gas, a compressor driven by an external power source, such as compressor 59 shown in FIG. 7, may be used in lieu of compressor 16. Other circumstances may not justify any compression of the stream at all, so that the stream flows directly to heat exchanger 60 as shown in FIG. 8 and by the dashed equipment (heat exchanger 24, compressor 16, and discharge cooler 25) in FIG. 1. If heat exchanger 24 is not included to heat the stream before the plant fuel gas (stream 48) is withdrawn, a supplemental heater 58 may be needed to warm the fuel gas before it is consumed, using a utility stream or another process stream to supply the necessary heat, as shown in FIGS. 6 through 8. Choices such as these must generally be evaluated for each application, as factors such as gas composition, plant size, desired co-product stream recovery level, and available equipment must all be considered.

In accordance with the present invention, the cooling of the inlet gas stream and the feed stream to the LNG production section may be accomplished in many ways. In the processes of FIGS. 1 and 3 through 8, inlet gas stream 31 is cooled and condensed by external refrigerant streams and flashed separator liquids. However, the cold process streams could also be used to supply some of the cooling to the high pressure refrigerant (stream 71*a*). Further, any stream at a temperature colder than the stream(s) being cooled may be utilized. For instance, a side draw of vapor from fractionation tower 19 in FIGS. 1 and 4 through 8 or absorber column 18 in FIG. 3 could be withdrawn and used for cooling. The use and distribution of tower liquids and/or vapors for process heat exchange, and the particular arrangement of heat exchangers for inlet gas and feed gas cooling, must be evaluated for each particular application, as well as the choice of process streams for specific heat exchange services. The selection of a source of cooling will depend on a number of factors including, but not limited to, feed gas composition and conditions, plant size, heat exchanger size, potential cooling source temperature, etc. One skilled in the art will also recognize that any combination of the above cooling sources or methods of cooling may be employed in combination to achieve the desired feed stream temperature(s).

Further, the supplemental external refrigeration that is supplied to the inlet gas stream and to the feed stream to the LNG production section may also be accomplished in many different ways. In FIGS. 1 and 3 through 8, boiling single-component refrigerant has been assumed for the high level external refrigeration and vaporizing multi-component refrigerant has been assumed for the low level external refrigeration, with the single-component refrigerant used to pre-cool the multi-component refrigerant stream. Alternatively, both the high level cooling and the low level cooling could be accomplished using single-component refrigerants with successively lower boiling points (i.e., "cascade refrigeration"), or one single-component refrigerant at successively lower evaporation pressures. As another alternative, both the high level cooling and the low level cooling could be accomplished using multi-component refrigerant streams with their respective compositions adjusted to provide the necessary cooling temperatures. The selection of the method for providing external refrigeration will depend on a number of factors including, but not limited to, feed gas composition and conditions, plant size, compressor driver size, heat exchanger size, ambient heat sink temperature, etc. One skilled in the art will also recognize that any combination of the methods for providing external refrigeration described above may be employed in combination to achieve the desired feed stream temperature(s).

Subcooling of the condensed liquid stream leaving heat exchanger 60 (stream 49*d* in FIGS. 1 and 3, stream 49*e* in FIG. 4, stream 49*c* in FIG. 5, stream 49*b* in FIGS. 6 and 7, and stream 49*a* in FIG. 8) reduces or eliminates the quantity of flash vapor that may be generated during expansion of the stream to the operating pressure of LNG storage tank 62. This generally reduces the specific power consumption for producing the LNG by eliminating the need for flash gas compression. However, some circumstances may favor reducing the capital cost of the facility by reducing the size of heat exchanger 60 and using flash gas compression or other means to dispose of any flash gas that may be generated.

Although individual stream expansion is depicted in particular expansion devices, alternative expansion means may be employed where appropriate. For example, conditions may warrant work expansion of the substantially condensed feed stream (stream 35*a* in FIGS. 1 and 3 through 8). Further, isenthalpic flash expansion may be used in lieu of work expansion for the subcooled liquid stream leaving heat exchanger 60 (stream 49*d* in FIGS. 1 and 3, stream 49*e* in FIG. 4, stream 49*c* in FIG. 5, stream 49*b* in FIGS. 6 and 7, and stream 49*a* in FIG. 8), but will necessitate either more subcooling in heat exchanger 60 to avoid forming flash vapor in the expansion, or else adding flash vapor compression or other means for disposing of the flash vapor that results. Similarly, isenthalpic flash expansion may be used in lieu of work expansion for the subcooled high pressure refrigerant stream leaving heat exchanger 60 (stream 71*c* in FIGS. 1 and 3 through 8), with the resultant increase in the power consumption for compression of the refrigerant.

It will also be recognized that the relative amount of feed found in each branch of the split vapor feed will depend on several factors, including gas pressure, feed gas composition, the amount of heat which can economically be extracted from the feed, the hydrocarbon components to be recovered in the liquid co-product stream, and the quantity of horsepower available. More feed to the top of the column may increase recovery while decreasing power recovered from the expander thereby increasing the recompression horsepower requirements. Increasing feed lower in the column reduces the horsepower consumption but may also reduce product recovery. The relative locations of the mid-column feeds may vary depending on inlet composition or other factors such as desired recovery levels and amount of liquid formed during inlet gas cooling. Moreover, two or more of the feed streams, or portions thereof, may be combined depending on the relative temperatures and quantities of individual streams, and the combined stream then fed to a mid-column feed position.

While there have been described what are believed to be preferred embodiments of the invention, those skilled in the art will recognize that other and further modifications may be made thereto, e.g. to adapt the invention to various conditions, types of feed, or other requirements without departing from the spirit of the present invention as defined by the following claims.

We claim:

1. In a process for liquefying a natural gas stream containing methane and heavier hydrocarbon components wherein (a) said natural gas stream is cooled under pressure to condense at least a portion of it and form a condensed stream; and (b) said condensed stream is expanded to lower pressure to form said liquefied natural gas stream;

the improvement wherein (1) said natural gas stream is treated in one or more cooling steps;

(2) said cooled natural gas stream is divided into at least a first stream and a second stream;

(3) said first stream is cooled to condense substantially all of it and thereafter expanded to an intermediate pressure;

(4) said second stream is expanded to said intermediate pressure;

(5) said expanded first stream and said expanded second stream are directed into a distillation column wherein said streams are separated into a more volatile vapor distillation stream and a relatively less volatile fraction containing a major portion of said heavier hydrocarbon components;

(6) a vapor distillation stream is withdrawn from a region of said distillation column below said expanded second stream and is cooled sufficiently to condense at least a part of it, thereby forming a residual vapor stream and a reflux stream;

(7) said reflux stream is directed into said distillation column as a top feed thereto;

(8) said residual vapor stream is combined with said more volatile vapor distillation stream to form a volatile residue gas fraction containing a major portion of said methane and lighter components; and (9) said volatile residue gas fraction is cooled under pressure to condense at least a portion of it and form thereby said condensed stream.

2. In a process for liquefying a natural gas stream containing methane and heavier hydrocarbon components wherein (a) said natural gas stream is cooled under pressure to condense at least a portion of it and form a condensed stream; and (b) said condensed stream is expanded to lower pressure to form said liquefied natural gas stream;

the improvement wherein (1) said natural gas stream is treated in one or more cooling steps to partially condense it;

(2) said partially condensed natural gas stream is separated to provide thereby a vapor stream and a liquid stream;

(3) said vapor stream is divided into at least a first stream and a second stream;

(4) said first stream is cooled to condense substantially all of it and thereafter expanded to an intermediate pressure;

(5) said second stream is expanded to said intermediate pressure;

(6) said liquid stream is expanded to said intermediate pressure;

(7) said expanded first stream, said expanded second stream, and said expanded liquid stream are directed into a distillation column wherein said streams are separated into a more volatile vapor distillation stream and a relatively less volatile fraction containing a major portion of said heavier hydrocarbon components;

(8) a vapor distillation stream is withdrawn from a region of said distillation column below said expanded second stream and is cooled sufficiently to condense at least a part of it, thereby forming a residual vapor stream and a reflux stream;

(9) said reflux stream is directed into said distillation column as a top feed thereto;

(10) said residual vapor stream is combined with said more volatile vapor distillation stream to form a volatile residue gas fraction containing a major portion of said methane and lighter components; and

(11) said volatile residue gas fraction is cooled under pressure to condense at least a portion of it and form thereby said condensed stream.

3. In a process for liquefying a natural gas stream containing methane and heavier hydrocarbon components wherein (a) said natural gas stream is cooled under pressure to condense at least a portion of it and form a condensed stream; and (b) said condensed stream is expanded to lower pressure to form said liquefied natural gas stream;

the improvement wherein (1) said natural gas stream is treated in one or more cooling steps to partially condense it;

(2) said partially condensed natural gas stream is separated to provide thereby a vapor stream and a liquid stream;

(3) said vapor stream is divided into at least a first stream and a second stream;

(4) said first stream is cooled to condense substantially all of it and thereafter expanded to an intermediate pressure;

(5) said second stream is expanded to said intermediate pressure;

(6) said liquid stream is expanded to said intermediate pressure and heated;

(7) said expanded first stream, said expanded second stream, and said heated expanded liquid stream are directed into a distillation column wherein said streams are separated into a more volatile vapor distillation stream and a relatively less volatile fraction containing a major portion of said heavier hydrocarbon components;

(8) a vapor distillation stream is withdrawn from a region of said distillation column below said expanded second stream and is cooled sufficiently to condense at least a part of it, thereby forming a residual vapor stream and a reflux stream;

(9) said reflux stream is directed into said distillation column as a top feed thereto;

(10) said residual vapor stream is combined with said more volatile vapor distillation stream to form a volatile residue gas fraction containing a major portion of said methane and lighter components; and

(11) said volatile residue gas fraction is cooled under pressure to condense at least a portion of it and form thereby said condensed stream.

4. In a process for liquefying a natural gas stream containing methane and heavier hydrocarbon components wherein (a) said natural gas stream is cooled under pressure to condense at least a portion of it and form a condensed stream; and (b) said condensed stream is expanded to lower pressure to form said liquefied natural gas stream;

the improvement wherein (1) said natural gas stream is treated in one or more cooling steps to partially condense it;

(2) said partially condensed natural gas stream is separated to provide thereby a vapor stream and a liquid stream;

(3) said vapor stream is divided into at least a first stream and a second stream;

(4) said first stream is combined with at least a portion of said liquid stream, forming thereby a combined stream;

(5) said combined stream is cooled to condense substantially all of it and thereafter expanded to an intermediate pressure;

(6) said second stream is expanded to said intermediate pressure;

(7) any remaining portion of said liquid stream is expanded to said intermediate pressure;

(8) said expanded combined stream, said expanded second stream, and said expanded remaining portion of said liquid stream are directed into a distillation column wherein said streams are separated into a more volatile vapor distillation stream and a relatively less volatile fraction containing a major portion of said heavier hydrocarbon components;

(9) a vapor distillation stream is withdrawn from a region of said distillation column below said expanded second stream and is cooled sufficiently to condense at least a part of it, thereby forming a residual vapor stream and a reflux stream;

(10) said reflux stream is directed into said distillation column as a top feed thereto;

(11) said residual vapor stream is combined with said more volatile vapor distillation stream to form a volatile residue gas fraction containing a major portion of said methane and lighter components; and

(12) said volatile residue gas fraction is cooled under pressure to condense at least a portion of it and form thereby said condensed stream.

5. In a process for liquefying a natural gas stream containing methane and heavier hydrocarbon components wherein (a) said natural gas stream is cooled under pressure to condense at least a portion of it and form a condensed stream; and (b) said condensed stream is expanded to lower pressure to form said liquefied natural gas stream;

the improvement wherein (1) said natural gas stream is treated in one or more cooling steps to partially condense it;

(2) said partially condensed natural gas stream is separated to provide thereby a vapor stream and a liquid stream;

(3) said vapor stream is divided into at least a first stream and a second stream;

(4) said first stream is combined with at least a portion of said liquid stream, forming thereby a combined stream;

(5) said combined stream is cooled to condense substantially all of it and thereafter expanded to an intermediate pressure;

(6) said second stream is expanded to said intermediate pressure;

(7) any remaining portion of said liquid stream is expanded to said intermediate pressure and heated;

(8) said expanded combined stream, said expanded second stream, and said heated expanded remaining portion of said liquid stream are directed into a distillation column wherein said streams are separated into a more volatile vapor distillation stream and a relatively less volatile fraction containing a major portion of said heavier hydrocarbon components;

(9) a vapor distillation stream is withdrawn from a region of said distillation column below said expanded second stream and is cooled sufficiently to condense at least a part of it, thereby forming a residual vapor stream and a reflux stream;

(10) said reflux stream is directed into said distillation column as a top feed thereto;

(11) said residual vapor stream is combined with said more volatile vapor distillation stream to form a volatile residue gas fraction containing a major portion of said methane and lighter components; and

(12) said volatile residue gas fraction is cooled under pressure to condense at least a portion of it and form thereby said condensed stream.

6. The improvement according to claim 1, 2, 3, 4, or 5 wherein a liquid distillation stream is withdrawn from said distillation column at a location above the region wherein said vapor distillation stream is withdrawn, whereupon said liquid distillation stream is heated and thereafter redirected into said distillation column as another feed thereto at a location below the region wherein said vapor distillation stream is withdrawn.

7. The improvement according to claim 1, 2, 3, 4, or 5 wherein said reflux stream is divided into at least a first portion and a second portion, whereupon said first portion is directed into said distillation column as a top feed thereto, and said second portion is supplied to said distillation column as another feed thereto, at a feed location in substantially the same region wherein said vapor distillation stream is withdrawn.

8. The improvement according to claim 6 wherein said reflux stream is divided into at least a first portion and a second portion, whereupon said first portion is directed into said distillation column as a top feed thereto, and said second portion is supplied to said distillation column as another feed thereto, at a feed location in substantially the same region wherein said vapor distillation stream is withdrawn.

9. The improvement according to claim 1, 2, 3, 4, or 5 wherein said volatile residue gas fraction is compressed and thereafter cooled under pressure to condense at least a portion of it and form thereby said condensed stream.

10. The improvement according to claim 6 wherein said volatile residue gas fraction is compressed and thereafter cooled under pressure to condense at least a portion of it and form thereby said condensed stream.

11. The improvement according to claim 7 wherein said volatile residue gas fraction is compressed and thereafter cooled under pressure to condense at least a portion of it and form thereby said condensed stream.

12. The improvement according to claim 8 wherein said volatile residue gas fraction is compressed and thereafter cooled under pressure to condense at least a portion of it and form thereby said condensed stream.

13. The improvement according to claim 1, 2, 3, 4, or 5 wherein said volatile residue gas fraction is heated, compressed, and thereafter cooled under pressure to condense at least a portion of it and form thereby said condensed stream.

14. The improvement according to claim 6 wherein said volatile residue gas fraction is heated, compressed, and thereafter cooled under pressure to condense at least a portion of it and form thereby said condensed stream.

15. The improvement according to claim 7 wherein said volatile residue gas fraction is heated, compressed, and thereafter cooled under pressure to condense at least a portion of it and form thereby said condensed stream.

16. The improvement according to claim 8 wherein said volatile residue gas fraction is heated, compressed, and thereafter cooled under pressure to condense at least a portion of it and form thereby said condensed stream.

17. The improvement according to claim 1, 2, 3, 4, or 5 wherein said volatile residue gas fraction contains a major portion of said methane, lighter components, and heavier hydrocarbon components selected from the group consisting of $C_2$ components and $C_2$ components+$C_3$ components.

18. The improvement according to claim 6 wherein said volatile residue gas fraction contains a major portion of said methane, lighter components, and heavier hydrocarbon components selected from the group consisting of $C_2$ components and $C_2$ components+$C_3$ components.

19. The improvement according to claim 7 wherein said volatile residue gas fraction contains a major portion of said methane, lighter components, and heavier hydrocarbon components selected from the group consisting of $C_2$ components and $C_2$ components+$C_3$ components.

20. The improvement according to claim 8 wherein said volatile residue gas fraction contains a major portion of said methane, lighter components, and heavier hydrocarbon components selected from the group consisting of $C_2$ components and $C_2$ components+$C_3$ components.

21. The improvement according to claim 9 wherein said volatile residue gas fraction contains a major portion of said methane, lighter components, and heavier hydrocarbon components selected from the group consisting of $C_2$ components and $C_2$ components+$C_3$ components.

22. The improvement according to claim 10 wherein said volatile residue gas fraction contains a major portion of said methane, lighter components, and heavier hydrocarbon components selected from the group consisting of $C_2$ components and $C_2$ components+$C_3$ components.

23. The improvement according to claim 11 wherein said volatile residue gas fraction contains a major portion of said methane, lighter components, and heavier hydrocarbon components selected from the group consisting of $C_2$ components and $C_2$ components+$C_3$ components.

24. The improvement according to claim 12 wherein said volatile residue gas fraction contains a major portion of said methane, lighter components, and heavier hydrocarbon components selected from the group consisting of $C_2$ components and $C_2$ components+$C_3$ components.

25. The improvement according to claim 13 wherein said volatile residue gas fraction contains a major portion of said methane, lighter components, and heavier hydrocarbon components selected from the group consisting of $C_2$ components and $C_2$ components+$C_3$ components.

26. The improvement according to claim 14 wherein said volatile residue gas fraction contains a major portion of said methane, lighter components, and heavier hydrocarbon components selected from the group consisting of $C_2$ components and $C_2$ components+$C_3$ components.

27. The improvement according to claim 15 wherein said volatile residue gas fraction contains a major portion of said methane, lighter components, and heavier hydrocarbon components selected from the group consisting of $C_2$ components and $C_2$ components+$C_3$ components.

28. The improvement according to claim 16 wherein said volatile residue gas fraction contains a major portion of said methane, lighter components, and heavier hydrocarbon components selected from the group consisting of $C_2$ components and $C_2$ components+$C_3$ components.

29. An apparatus for the liquefaction of a natural gas stream containing methane and heavier hydrocarbon components, which includes (1) one or more first heat exchange means to receive said natural gas stream and cool it under pressure;

(2) dividing means connected to said first heat exchange means to receive said cooled natural gas stream and divide it into at least a first stream and a second stream;

(3) second heat exchange means connected to said dividing means to receive said first stream and to cool it sufficiently to substantially condense it;

(4) first expansion means connected to said second heat exchange means to receive said substantially condensed first stream and expand it to an intermediate pressure;

(5) second expansion means connected to said dividing means to receive said second stream and expand it to said intermediate pressure;

(6) a distillation column connected to said first expansion means and said second expansion means to receive said expanded first stream and said expanded second stream, with said distillation column adapted to separate said streams into a more volatile vapor distillation stream and a relatively less volatile fraction containing a major portion of said heavier hydrocarbon components;

(7) vapor withdrawing means connected to said distillation column to receive a vapor distillation stream from a region of said distillation column below said expanded second stream;

(8) third heat exchange means connected to said vapor withdrawing means to receive said vapor distillation stream and cool it sufficiently to condense at least a part of it;

(9) separation means connected to said third heat exchange means to receive said cooled partially condensed distillation stream and separate it into a residual vapor stream and a reflux stream, said separation means being further connected to said distillation column to direct said reflux stream into said distillation column as a top feed thereto;

(10) combining means connected to said distillation column and said separation means to receive said more volatile vapor distillation stream and said residual vapor stream and form a volatile residue gas fraction containing a major portion of said methane and lighter components;

(11) fourth heat exchange means connected to said combining means to receive said volatile residue gas fraction, with said fourth heat exchange means adapted to cool said volatile residue gas fraction under pressure to condense at least a portion of it and form thereby a condensed stream;

(12) third expansion means connected to said fourth heat exchange means to receive said condensed stream and expand it to lower pressure to form said liquefied natural gas stream; and

(13) control means adapted to regulate the quantities and temperatures of said feed streams to said distillation column to maintain the overhead temperature of said distillation column at a temperature whereby the major portion of said heavier hydrocarbon components is recovered in said relatively less volatile fraction.

30. An apparatus for the liquefaction of a natural gas stream containing methane and heavier hydrocarbon components, which includes (1) one or more first heat exchange means to receive said natural gas stream and cool it under pressure sufficiently to partially condense it;

(2) first separation means connected to said first heat exchange means to receive said partially condensed natural gas stream and separate it into a vapor stream and a liquid stream;

(3) dividing means connected to said first separation means to receive said vapor stream and divide it into at least a first stream and a second stream;

(4) second heat exchange means connected to said dividing means to receive said first stream and to cool it sufficiently to substantially condense it;

(5) first expansion means connected to said second heat exchange means to receive said substantially condensed first stream and expand it to an intermediate pressure;

(6) second expansion means connected to said dividing means to receive said second stream and expand it to said intermediate pressure;

(7) third expansion means connected to said first separation means to receive said liquid stream and expand it to said intermediate pressure;

(8) a distillation column connected to said first expansion means, said second expansion means, and said third expansion means to receive said expanded first stream, said expanded second stream, and said expanded liquid stream, with said distillation column adapted to separate said streams into a more volatile vapor distillation stream and a relatively less volatile fraction containing a major portion of said heavier hydrocarbon components;

(9) vapor withdrawing means connected to said distillation column to receive a vapor distillation stream from a region of said distillation column below said expanded second stream;

(10) third heat exchange means connected to said vapor withdrawing means to receive said vapor distillation stream and cool it sufficiently to condense at least a part of it;

(11) second separation means connected to said third heat exchange means to receive said cooled partially condensed distillation stream and separate it into a residual vapor stream and a reflux stream, said second separation means being further connected to said distillation column to direct said reflux stream into said distillation column as a top feed thereto;

(12) combining means connected to said distillation column and said second separation means to receive said more volatile vapor distillation stream and said residual vapor stream and form a volatile residue gas fraction containing a major portion of said methane and lighter components;

(13) fourth heat exchange means connected to said combining means to receive said volatile residue gas fraction, with said fourth heat exchange means adapted to cool said volatile residue gas fraction under pressure to condense at least a portion of it and form thereby a condensed stream;

(14) fourth expansion means connected to said fourth heat exchange means to receive said condensed stream and expand it to lower pressure to form said liquefied natural gas stream; and

(15) control means adapted to regulate the quantities and temperatures of said feed streams to said distillation column to maintain the overhead temperature of said distillation column at a temperature whereby the major portion of said heavier hydrocarbon components is recovered in said relatively less volatile fraction.

31. An apparatus for the liquefaction of a natural gas stream containing methane and heavier hydrocarbon components, which includes (1) one or more first heat exchange means to receive said natural gas stream and cool it under pressure sufficiently to partially condense it;

(2) first separation means connected to said first heat exchange means to receive said partially condensed natural gas stream and separate it into a vapor stream and a liquid stream;

(3) dividing means connected to said first separation means to receive said vapor stream and divide it into at least a first stream and a second stream;

(4) second heat exchange means connected to said dividing means to receive said first stream and to cool it sufficiently to substantially condense it;

(5) first expansion means connected to said second heat exchange means to receive said substantially condensed first stream and expand it to an intermediate pressure;

(6) second expansion means connected to said dividing means to receive said second stream and expand it to said intermediate pressure;

(7) third expansion means connected to said first separation means to receive said liquid stream and expand it to said intermediate pressure;

(8) heating means connected to said third expansion means to receive said expanded liquid stream and heat it;

(9) a distillation column connected to said first expansion means, said second expansion means, and said heating means to receive said expanded first stream, said expanded second stream, and said heated expanded liquid stream, with said distillation column adapted to separate said streams into a more volatile vapor distillation stream and a relatively less volatile fraction containing a major portion of said heavier hydrocarbon components;

(10) vapor withdrawing means connected to said distillation column to receive a vapor distillation stream from a region of said distillation column below said expanded second stream;

(11) third heat exchange means connected to said vapor withdrawing means to receive said vapor distillation stream and cool it sufficiently to condense at least a part of it;

(12) second separation means connected to said third heat exchange means to receive said cooled partially condensed distillation stream and separate it into a residual vapor stream and a reflux stream, said second separation means being further connected to said distillation column to direct said reflux stream into said distillation column as a top feed thereto;

(13) combining means connected to said distillation column and said second separation means to receive said more volatile vapor distillation stream and said residual vapor stream and form a volatile residue gas fraction containing a major portion of said methane and lighter components;

(14) fourth heat exchange means connected to said combining means to receive said volatile residue gas fraction, with said fourth heat exchange means adapted to cool said volatile residue gas fraction under pressure to condense at least a portion of it and form thereby a condensed stream;

(15) fourth expansion means connected to said fourth heat exchange means to receive said condensed stream and expand it to lower pressure to form said liquefied natural gas stream; and

(16) control means adapted to regulate the quantities and temperatures of said feed streams to said distillation column to maintain the overhead temperature of said distillation column at a temperature whereby the major portion of said heavier hydrocarbon components is recovered in said relatively less volatile fraction.

32. An apparatus for the liquefaction of a natural gas stream containing methane and heavier hydrocarbon components, which includes (1) one or more first heat exchange means to receive said natural gas stream and cool it under pressure sufficiently to partially condense it;

(2) first separation means connected to said first heat exchange means to receive said partially condensed natural gas stream and separate it into a vapor stream and a liquid stream;

(3) dividing means connected to said first separation means to receive said vapor stream and divide it into at least a first stream and a second stream;

(4) first combining means connected to said dividing means and to said first separation means to receive said first stream and at least a portion of said liquid stream and form thereby a combined stream;

(5) second heat exchange means connected to said first combining means to receive said combined stream and to cool it sufficiently to substantially condense it;

(6) first expansion means connected to said second heat exchange means to receive said substantially condensed combined stream and expand it to an intermediate pressure;

(7) second expansion means connected to said dividing means to receive said second stream and expand it to said intermediate pressure;

(8) third expansion means connected to said first separation means to receive any remaining portion of said liquid stream and expand it to said intermediate pressure;

(9) a distillation column connected to said first expansion means, said second expansion means, and said third expansion means to receive said expanded combined stream, said expanded second stream, and said expanded remaining portion of said liquid stream, with said distillation column adapted to separate said streams into said more volatile vapor distillation stream and a relatively less volatile fraction containing a major portion of said heavier hydrocarbon components;

(10) vapor withdrawing means connected to said distillation column to receive a vapor distillation stream from a region of said distillation column below said expanded second stream;

(11) third heat exchange means connected to said vapor withdrawing means to receive said vapor distillation stream and cool it sufficiently to condense at least a part of it;

(12) second separation means connected to said third heat exchange means to receive said cooled partially condensed distillation stream and separate it into a residual vapor stream and a reflux stream, said second separation means being further connected to said distillation column to direct said reflux stream into said distillation column as a top feed thereto;

(13) second combining means connected to said distillation column and said second separation means to receive said more volatile vapor distillation stream and said residual vapor stream and form a volatile residue gas fraction containing a major portion of said methane and lighter components;

(14) fourth heat exchange means connected to said second combining means to receive said volatile residue gas fraction, with said fourth heat exchange means adapted to cool said volatile residue gas fraction under pressure to condense at least a portion of it and form thereby a condensed stream;

(15) fourth expansion means connected to said fourth heat exchange means to receive said condensed stream and expand it to lower pressure to form said liquefied natural gas stream; and

(16) control means adapted to regulate the quantities and temperatures of said feed streams to said distillation column to maintain the overhead temperature of said distillation column at a temperature whereby the major portion of said heavier hydrocarbon components is recovered in said relatively less volatile fraction.

33. An apparatus for the liquefaction of a natural gas stream containing methane and heavier hydrocarbon components, which includes (1) one or more first heat exchange means to receive said natural gas stream and cool it under pressure sufficiently to partially condense it;

(2) first separation means connected to said first heat exchange means to receive said partially condensed natural gas stream and separate it into a vapor stream and a liquid stream;

(3) dividing means connected to said first separation means to receive said vapor stream and divide it into at least a first stream and a second stream;

(4) first combining means connected to said dividing means and to said first separation means to receive said first stream and at least a portion of said liquid stream and form thereby a combined stream;

(5) second heat exchange means connected to said first combining means to receive said combined stream and to cool it sufficiently to substantially condense it;

(6) first expansion means connected to said second heat exchange means to receive said substantially condensed combined stream and expand it to an intermediate pressure;

(7) second expansion means connected to said dividing means to receive said second stream and expand it to said intermediate pressure;

(8) third expansion means connected to said first separation means to receive any remaining portion of said liquid stream and expand it to said intermediate pressure;

(9) heating means connected to said third expansion means to receive said expanded liquid stream and heat it;

(10) a distillation column connected to said first expansion means, said second expansion means, and said heating means to receive said expanded combined stream, said expanded second stream, and said heated expanded remaining portion of said liquid stream, with said distillation column adapted to separate said streams into said more volatile vapor distillation stream and a relatively less volatile fraction containing a major portion of said heavier hydrocarbon components;

(11) vapor withdrawing means connected to said distillation column to receive a vapor distillation stream from a region of said distillation column below said expanded second stream;

(12) third heat exchange means connected to said vapor withdrawing means to receive said vapor distillation stream and cool it sufficiently to condense at least a part of it;

(13) second separation means connected to said third heat exchange means to receive said cooled partially condensed distillation stream and separate it into a residual vapor stream and a reflux stream, said second separation means being further connected to said distillation column to direct said reflux stream into said distillation column as a top feed thereto;

(14) second combining means connected to said distillation column and said second separation means to receive said more volatile vapor distillation stream and said residual vapor stream and form a volatile residue gas fraction containing a major portion of said methane and lighter components;

(15) fourth heat exchange means connected to said second combining means to receive said volatile residue gas fraction, with said fourth heat exchange means adapted to cool said volatile residue gas fraction under pressure to condense at least a portion of it and form thereby a condensed stream;

(16) fourth expansion means connected to said fourth heat exchange means to receive said condensed stream and expand it to lower pressure to form said liquefied natural gas stream; and

(17) control means adapted to regulate the quantities and temperatures of said feed streams to said distillation column to maintain the overhead temperature of said distillation column at a temperature whereby the major portion of said heavier hydrocarbon components is recovered in said relatively less volatile fraction.

34. The apparatus according to claim 29 wherein said apparatus includes (1) liquid withdrawing means connected to said distillation column to receive a liquid distillation stream at a location above the region wherein said vapor distillation stream is withdrawn; and (2) heating means connected to said liquid withdrawing means to receive said liquid distillation stream and heat it, said heating means being further connected to said distillation column to direct said heated liquid distillation stream into said distillation column as another feed thereto at a location below the region wherein said vapor distillation stream is withdrawn.

35. The apparatus according to claim 30 wherein said apparatus includes (1) liquid withdrawing means connected to said distillation column to receive a liquid distillation stream at a location above the region wherein said vapor distillation stream is withdrawn; and (2) heating means connected to said liquid withdrawing means to receive said liquid distillation stream and heat it, said heating means being further connected to said distillation column to direct said heated liquid distillation stream into said distillation column as another feed thereto at a location below the region wherein said vapor distillation stream is withdrawn.

36. The apparatus according to claim 31 wherein said apparatus includes (1) liquid withdrawing means connected to said distillation column to receive a liquid distillation stream at a location above the region wherein said vapor distillation stream is withdrawn; and (2) second heating means connected to said liquid withdrawing means to receive said liquid distillation stream and heat it, said second heating means being further connected to said distillation column to direct said heated liquid distillation stream into said distillation column as another feed thereto at a location below the region wherein said vapor distillation stream is withdrawn.

37. The apparatus according to claim 32 wherein said apparatus includes (1) liquid withdrawing means connected to said distillation column to receive a liquid distillation stream at a location above the region wherein said vapor distillation stream is withdrawn; and (2) heating means connected to said liquid withdrawing means to receive said liquid distillation stream and heat it, said heating means being further connected to said distillation column to direct said heated liquid distillation stream into said distillation column as another feed thereto at a location below the region wherein said vapor distillation stream is withdrawn.

38. The apparatus according to claim 33 wherein said apparatus includes (1) liquid withdrawing means connected to said distillation column to receive a liquid distillation stream at a location above the region wherein said vapor distillation stream is withdrawn; and (2) second heating means connected to said liquid withdrawing means to receive said liquid distillation stream and heat it, said second heating means being further connected to said distillation column to direct said heated liquid distillation stream into said distillation column as another feed thereto at a location below the region wherein said vapor distillation stream is withdrawn.

39. The improvement according to claim 29 wherein said apparatus includes (1) second dividing means connected to said separating means to divide said reflux stream into at least a first portion and a second portion;

(2) said second dividing means being further connected to said distillation column to direct said first portion into said distillation column as a top feed thereto; and (3) said second dividing means being further connected to said distillation column to supply said second portion to said distillation column at a feed position in substantially the same region wherein said vapor distillation stream is withdrawn.

40. The improvement according to claim 30 wherein said apparatus includes (1) second dividing means connected to said second separating means to divide said reflux stream into at least a first portion and a second portion;

(2) said second dividing means being further connected to said distillation column to direct said first portion into said distillation column as a top feed thereto; and (3) said second dividing means being further connected to said distillation column to supply said second portion to said distillation column at a feed position in substantially the same region wherein said vapor distillation stream is withdrawn.

41. The improvement according to claim 31 wherein said apparatus includes (1) second dividing means connected to said second separating means to divide said reflux stream into at least a first portion and a second portion;

(2) said second dividing means being further connected to said distillation column to direct said first portion into said distillation column as a top feed thereto; and (3) said second dividing means being further connected to said distillation column to supply said second portion to said distillation column at a feed position in substantially the same region wherein said vapor distillation stream is withdrawn.

42. The improvement according to claim 32 wherein said apparatus includes (1) second dividing means connected to said second separating means to divide said reflux stream into at least a first portion and a second portion;

(2) said second dividing means being further connected to said distillation column to direct said first portion into said distillation column as a top feed thereto; and (3) said second dividing means being further connected to said distillation column to supply said second portion to said distillation column at a feed position in substantially the same region wherein said vapor distillation stream is withdrawn.

43. The improvement according to claim 33 wherein said apparatus includes (1) second dividing means connected to said second separating means to divide said reflux stream into at least a first portion and a second portion;

(2) said second dividing means being further connected to said distillation column to direct said first portion into said distillation column as a top feed thereto; and (3) said second dividing means being further connected to said distillation column to supply said second portion to said distillation column at a feed position in substantially the same region wherein said vapor distillation stream is withdrawn.

44. The improvement according to claim 34 wherein said apparatus includes (1) second dividing means connected to said separating means to divide said reflux stream into at least a first portion and a second portion;

(2) said second dividing means being further connected to said distillation column to direct said first portion into said distillation column as a top feed thereto; and (3) said second dividing means being further connected to said distillation column to supply said second portion to said distillation column at a feed position in substantially the same region wherein said vapor distillation stream is withdrawn.

45. The improvement according to claim 35 wherein said apparatus includes (1) second dividing means connected to said second separating means to divide said reflux stream into at least a first portion and a second portion;

(2) said second dividing means being further connected to said distillation column to direct said first portion into said distillation column as a top feed thereto; and (3) said second dividing means being further connected to said distillation column to supply said second portion to said distillation column at a feed position in substantially the same region wherein said vapor distillation stream is withdrawn.

46. The improvement according to claim 36 wherein said apparatus includes (1) second dividing means connected to said second separating means to divide said reflux stream into at least a first portion and a second portion;

(2) said second dividing means being further connected to said distillation column to direct said first portion into said distillation column as a top feed thereto; and (3) said second dividing means being further connected to said distillation column to supply said second portion to said distillation column at a feed position in substantially the same region wherein said vapor distillation stream is withdrawn.

47. The improvement according to claim 37 wherein said apparatus includes (1) second dividing means connected to said second separating means to divide said reflux stream into at least a first portion and a second portion;

(2) said second dividing means being further connected to said distillation column to direct said first portion into said distillation column as a top feed thereto; and (3) said second dividing means being further connected to said distillation column to supply said second portion to said distillation column at a feed position in substantially the same region wherein said vapor distillation stream is withdrawn.

48. The improvement according to claim 38 wherein said apparatus includes (1) second dividing means connected to said second separating means to divide said reflux stream into at least a first portion and a second portion;

(2) said second dividing means being further connected to said distillation column to direct said first portion into said distillation column as a top feed thereto; and (3) said second dividing means being further connected to said distillation column to supply said second portion to said distillation column at a feed position in substantially the same region wherein said vapor distillation stream is withdrawn.

49. The apparatus according to claim 29, 30, 31, 34, 35, 36, 39, 40, 41, 44, 45, or 46 wherein said apparatus includes (1) compressing means connected to said combining means to receive said volatile residue gas fraction and compress it; and (2) said fourth heat exchange means connected to said compressing means to receive said compressed volatile residue gas fraction, with said fourth heat exchange means adapted to cool said compressed volatile residue gas fraction under pressure to condense at least a portion of it and form thereby said condensed stream.

50. The apparatus according to claim 32, 33, 37, 38, 42, 43, 47, or 48 wherein said apparatus includes (1) compressing means connected to said second combining means to receive said volatile residue gas fraction and compress it; and (2) said fourth heat exchange means connected to said compressing means to receive said compressed volatile residue gas fraction, with said fourth heat exchange means adapted to cool said compressed volatile residue gas fraction under pressure to condense at least a portion of it and form thereby said condensed stream.

51. The apparatus according to claim 29, 30, 39, or 40 wherein said apparatus includes (1) heating means connected to said combining means to receive said volatile residue gas fraction and heat it;

(2) compressing means connected to said heating means to receive said heated volatile residue gas fraction and compress it; and (3) said fourth heat exchange means connected to said compressing means to receive said compressed heated volatile residue gas fraction, with said fourth heat exchange means adapted to cool said compressed heated volatile residue gas fraction under pressure to condense at least a portion of it and form thereby said condensed stream.

52. The apparatus according to claim 31, 34, 35, 41, 44, or 45 wherein said apparatus includes (1) second heating means connected to said combining means to receive said volatile residue gas fraction and heat it;

(2) compressing means connected to said second heating means to receive said heated volatile residue gas fraction and compress it; and (3) said fourth heat exchange means connected to said compressing means to receive said compressed heated volatile residue gas fraction, with said fourth heat exchange means adapted to cool said compressed heated volatile residue gas fraction under pressure to condense at least a portion of it and form thereby said condensed stream.

53. The apparatus according to claim 36 or 46 wherein said apparatus includes (1) third heating means connected to said combining means to receive said volatile residue gas fraction and heat it;

(2) compressing means connected to said third heating means to receive said heated volatile residue gas fraction and compress it; and (3) said fourth heat exchange means connected to said compressing means to receive said compressed heated volatile residue gas fraction, with said fourth heat exchange means adapted to cool said compressed heated volatile residue gas fraction under pressure to condense at least a portion of it and form thereby said condensed stream.

54. The apparatus according to claim 32 or 42 wherein said apparatus includes (1) heating means connected to said second combining means to receive said volatile residue gas fraction and heat it;

(2) compressing means connected to said heating means to receive said heated volatile residue gas fraction and compress it; and (3) said fourth heat exchange means connected to said compressing means to receive said compressed heated volatile residue gas fraction, with said fourth heat exchange means adapted to cool said compressed heated volatile residue gas fraction under pressure to condense at least a portion of it and form thereby said condensed stream.

55. The apparatus according to claim 33, 37, 43, or 47 wherein said apparatus includes (1) second heating means connected to said second combining means to receive said volatile residue gas fraction and heat it;

(2) compressing means connected to said second heating means to receive said heated volatile residue gas fraction and compress it; and (3) said fourth heat exchange means connected to said compressing means to receive said compressed heated volatile residue gas fraction, with said fourth heat exchange means adapted to cool said compressed heated volatile residue gas fraction under pressure to condense at least a portion of it and form thereby said condensed stream.

56. The apparatus according to claim 38 or 48 wherein said apparatus includes (1) third heating means connected to said second combining means to receive said volatile residue gas fraction and heat it;

(2) compressing means connected to said third heating means to receive said heated volatile residue gas fraction and compress it; and (3) said fourth heat exchange means connected to said compressing means to receive said compressed heated volatile residue gas fraction, with said fourth heat exchange means adapted to cool said compressed heated volatile residue gas fraction under pressure to condense at least a portion of it and form thereby said condensed stream.

57. The apparatus according to claim 29, 30, 31, 32, 33, 34, 35, 36, 37, 38, 39, 40, 41, 42, 43, 44, 45, 46, 47, or 48 wherein said volatile residue gas fraction contains a major portion of said methane, lighter components, and heavier hydrocarbon components selected from the group consisting of $C_2$ components and $C_2$ components+$C_3$ components.

58. The apparatus according to claim 49 wherein said volatile residue gas fraction contains a major portion of said methane, lighter components, and heavier hydrocarbon components selected from the group consisting of $C_2$ components and $C_2$ components+$C_3$ components.

59. The apparatus according to claim 50 wherein said volatile residue gas fraction contains a major portion of said methane, lighter components, and heavier hydrocarbon components selected from the group consisting of $C_2$ components and $C_2$ components+$C_3$ components.

60. The apparatus according to claim 51 wherein said volatile residue gas fraction contains a major portion of said methane, lighter components, and heavier hydrocarbon components selected from the group consisting of $C_2$ components and $C_2$ components+$C_3$ components.

61. The apparatus according to claim 52 wherein said volatile residue gas fraction contains a major portion of said methane, lighter components, and heavier hydrocarbon components selected from the group consisting of $C_2$ components and $C_2$ components+$C_3$ components.

62. The apparatus according to claim 53 wherein said volatile residue gas fraction contains a major portion of said methane, lighter components, and heavier hydrocarbon components selected from the group consisting of $C_2$ components and $C_2$ components+$C_3$ components.

63. The apparatus according to claim 54 wherein said volatile residue gas fraction contains a major portion of said methane, lighter components, and heavier hydrocarbon components selected from the group consisting of $C_2$ components and $C_2$ components+$C_3$ components.

64. The apparatus according to claim 55 wherein said volatile residue gas fraction contains a major portion of said methane, lighter components, and heavier hydrocarbon components selected from the group consisting of $C_2$ components and $C_2$ components+$C_3$ components.

65. The apparatus according to claim 56 wherein said volatile residue gas fraction contains a major portion of said methane, lighter components, and heavier hydrocarbon components selected from the group consisting of $C_2$ components and $C_2$ components+$C_3$ components.

* * * * *